US011906185B2

(12) United States Patent
Koyano et al.

(10) Patent No.: US 11,906,185 B2
(45) Date of Patent: Feb. 20, 2024

(54) STATE ANALYZER SYSTEM AND STATE ANALYSIS DEVICE

(71) Applicant: Mitsubishi Electric Corporation, Tokyo (JP)

(72) Inventors: Takehiro Koyano, Tokyo (JP); Yasutaka Ochiai, Tokyo (JP); Kosuke Tanaka, Tokyo (JP); Yoshiaki Koizumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 878 days.

(21) Appl. No.: 16/960,762

(22) PCT Filed: Jan. 25, 2018

(86) PCT No.: PCT/JP2018/002260
§ 371 (c)(1),
(2) Date: Jul. 8, 2020

(87) PCT Pub. No.: WO2019/146035
PCT Pub. Date: Aug. 1, 2019

(65) Prior Publication Data

US 2020/0340702 A1 Oct. 29, 2020

(51) Int. Cl.
*F24F 11/63* (2018.01)
*F25B 49/00* (2006.01)
(Continued)

(52) U.S. Cl.
CPC ..... *F24F 11/63* (2018.01); *F24F 11/32* (2018.01); *F24F 11/38* (2018.01); *F24F 11/49* (2018.01);
(Continued)

(58) Field of Classification Search
CPC .. F24F 11/63; F24F 11/38; F24F 11/49; F24F 1/32; F24F 11/30; F24F 11/52;
(Continued)

(56) References Cited

U.S. PATENT DOCUMENTS

2007/0204635 A1* 9/2007 Tanaka ..... F25B 13/00 62/129
2009/0077983 A1* 3/2009 Singh ..... F25B 49/005 62/126
(Continued)

FOREIGN PATENT DOCUMENTS

EP 1 731 857 A1 12/2006
JP 63297974 A * 12/1988
(Continued)

OTHER PUBLICATIONS

Office Action dated Apr. 22, 2022 issued in corresponding European Patent Application No. 18902989.5.
(Continued)

*Primary Examiner* — Jeffrey P Aiello
(74) *Attorney, Agent, or Firm* — POSZ LAW GROUP, PLC

(57) ABSTRACT

A state analysis device and a state analyzer system include a specific state determination unit that determines specific state information representing a state of refrigerant at a specific position in a refrigeration circuit and a normal region determination unit that determines a normal region in a state space within which the specific state information is present when an air-conditioning apparatus operates under a normal state. The state analysis device and the state analyzer system allow a display to display the specific state information and the normal region.

24 Claims, 15 Drawing Sheets

(51) Int. Cl.

| | |
|---|---|
| ***F24F 11/38*** | (2018.01) |
| ***F24F 11/32*** | (2018.01) |
| ***F24F 11/49*** | (2018.01) |

(52) U.S. Cl.
CPC ..... *F25B 49/005* (2013.01); *F25B 2500/19* (2013.01)

(58) Field of Classification Search
CPC .... F24F 2110/10; F24F 11/62; F24F 2110/00; F24F 2140/00; F25B 13/00; F25B 2313/0314; F25B 2313/0315; F25B 2400/054; F25B 2400/053; F25B 49/02; F25B 49/005; F25B 49/022; F25B 2500/19; F25B 2700/21152; F25B 2700/21161; F25B 2700/21171

USPC ..... 62/115, 125–127, 129, 186, 222, 62/228.1–228.3, 498; 165/11.1, 45, 165/104.21; 374/1.005, 112, 134; 700/17, 275–278, 282, 300; 702/50, 85, 702/99, 127, 130, 136, 179, 182–183, 702/185, 189
See application file for complete search history.

(56) References Cited

U.S. PATENT DOCUMENTS

| | | | | |
|---|---|---|---|---|
| 2009/0151377 | A1* | 6/2009 | Yonemori | F25B 49/005 62/203 |
| 2016/0169572 | A1* | 6/2016 | Noboa | F25B 13/00 62/115 |
| 2017/0337525 | A1* | 11/2017 | Yoshida | G01M 99/005 |

FOREIGN PATENT DOCUMENTS

| | | | |
|---|---|---|---|
| JP | S63-297974 | A | 12/1988 |
| JP | H01-174870 | A | 7/1989 |
| JP | 2008-232580 | A | 10/2008 |
| JP | 2011-007457 | A | 1/2011 |
| JP | 2013-155970 | A | 8/2013 |
| JP | 2015-092121 | A | 5/2015 |
| JP | 5905278 | B2 | 3/2016 |
| JP | 2017-207265 | A | 11/2017 |

OTHER PUBLICATIONS

International Search Report of the International Searching Authority dated Apr. 3, 2018 for the corresponding International application No. PCT/JP2018/002260 (and English translation).
Examination Report dated May 8, 2021, issued in corresponding AU Patent Application No. 2018404247.
Office Action dated Jun. 1, 2021, issued in corresponding JP Patent Application No. 2019-567460 (and English Machine Translation).
Office Action dated Nov. 30, 2021, issued in corresponding in Patent Application No. 202027028317 (and English Machine Translation).
European Office Action dated Dec. 17, 2020, issued in corresponding EP Patent Application No. 18902989.5.

* cited by examiner

STATE ANALYZER SYSTEM AND STATE ANALYSIS DEVICE

CROSS REFERENCE TO RELATED APPLICATION

This application is a U.S. national stage application of PCT/JP2018/002260 filed on Jan. 25, 2018, the contents of which are incorporated herein by reference.

TECHNICAL FIELD

The present invention relates to a state analyzer system and a state analysis device that analyze a state of an air-conditioning apparatus.

BACKGROUND ART

An air-conditioning apparatus configured to control an air environment in a space such as a room has become widespread, and is indispensable for maintaining the comfort of the space. Therefore, a malfunction of the air-conditioning apparatus directly leads to a user's unpleasant feeling. In addition, a malfunction of an air-conditioning apparatus disposed in a server room, a freezing storage room, and the like may lead to a fatal loss in business. For this reason, in recent years, attention has been focused on a technique for analyzing a state of the air-conditioning apparatus and knowing a malfunction and a symptom of the malfunction of the air-conditioning apparatus.

The air-conditioning apparatus includes a refrigerant circuit in which refrigerant circulates, and an abnormality in the air-conditioning apparatus affects a refrigeration cycle chart in which a refrigeration cycle indicating a change in the state of refrigerant is displayed on a p-h chart. In the p-h chart, a vertical axis represents a pressure, and a horizontal axis represents an enthalpy. Accordingly, the refrigeration cycle chart shows changes in pressure and enthalpy in each process of the change in the state of refrigerant.

Conventionally, a method has also been adopted in which a refrigeration cycle chart based on a current operation state and a pre-stored refrigeration cycle chart in a normal state are displayed on the same p-h chart (for example, see Patent Literature 1). In Patent Literature 1, when it is determined from a non-overlap ratio between the refrigeration cycle charts that maintenance is necessary, the necessity of maintenance in an air-conditioning apparatus is displayed on a display device.

CITATION LIST

Patent Literature

Patent Literature 1: Japanese Unexamined Patent Application Publication No. 2015-92121

SUMMARY OF INVENTION

Technical Problem

However, a difference in shape between the current refrigeration cycle chart and the refrigeration cycle chart in the normal state depends on factors of the abnormality and a degree of abnormality in the air-conditioning apparatus. Since various environments inside and outside the refrigerant circuit are reflected on the refrigeration cycle chart, it is difficult to diagnose the state of the air-conditioning apparatus based on the difference in shape or the non-overlap ratio between the refrigeration cycle charts. In other words, the configuration disclosed in Patent Literature 1 has a problem that the user cannot easily diagnose the factor of the abnormality and the degree of abnormality in the air-conditioning apparatus.

The present invention has been made to solve the above problem, and an object thereof is to provide a state analyzer system and a state analysis device that allow the user to easily diagnose the factor of the abnormality and the degree of abnormality in the air-conditioning apparatus.

Solution to Problem

A state analyzer system according to an embodiment of the present invention includes: an air-conditioning apparatus including a refrigerant circuit including a compressor and an expansion unit, a state detection unit configured to detect a state of refrigerant in the refrigerant circuit as state data, and a controller configured to control the compressor and the expansion unit; a specific state determination unit configured to determine specific state information by using the state data and control data, the control data indicating a content of control performed by the controller, the specific state information representing a state of the refrigerant at a specific position in the refrigeration circuit, and being located in a state space defined by a first parameter and a second parameter; a normal region determination unit configured to determine, by using the state data and the control data, a normal region in the state space within which the specific state information is present when the air-conditioning apparatus operates under a normal state; and a display unit configured to display the specific state information determined by the specific state determination unit, and a normal region determined by the normal region determination unit.

A state analysis device according to another embodiment of the present invention is a state analysis device that analyzes a state of an air-conditioning apparatus by using state data and control data and allows a display unit, which is provided outside, to display an analysis result, the air-conditioning apparatus including a refrigerant circuit including a compressor and an expansion unit and a controller configured to control the compressor and the expansion unit, the state data indicating a state of refrigerant in the refrigerant circuit, the control data indicating a content of control performed by the controller, the state analysis device including: a specific state determination unit configured to determine specific state information by using the state data and the control data, the specific state information representing a state of the refrigerant at a specific position in the refrigeration circuit, and being located in a state space defined by a first parameter and a second parameter; a normal region determination unit configured to determine, by using the state data and the control data, a normal region in the state space within which the specific state information is present when the air-conditioning apparatus operates under a normal state; and a display processing unit configured to allow the display unit to display the specific state information determined by the specific state determination unit, and a normal region determined by the normal region determination unit.

Advantageous Effects of Invention

According to the present invention, it is possible to display specific state information corresponding to a specific position of a refrigerant circuit and a normal region within which specific state information is present during a normal operation of an air-conditioning apparatus, thereby allowing a user to visually recognize a position of the specific state information with respect to the normal region. Accordingly, the user can easily diagnose a factor of an abnormality and a degree of abnormality in the air-conditioning apparatus.

DESCRIPTION OF EMBODIMENTS

Embodiment 1

Figure 1:
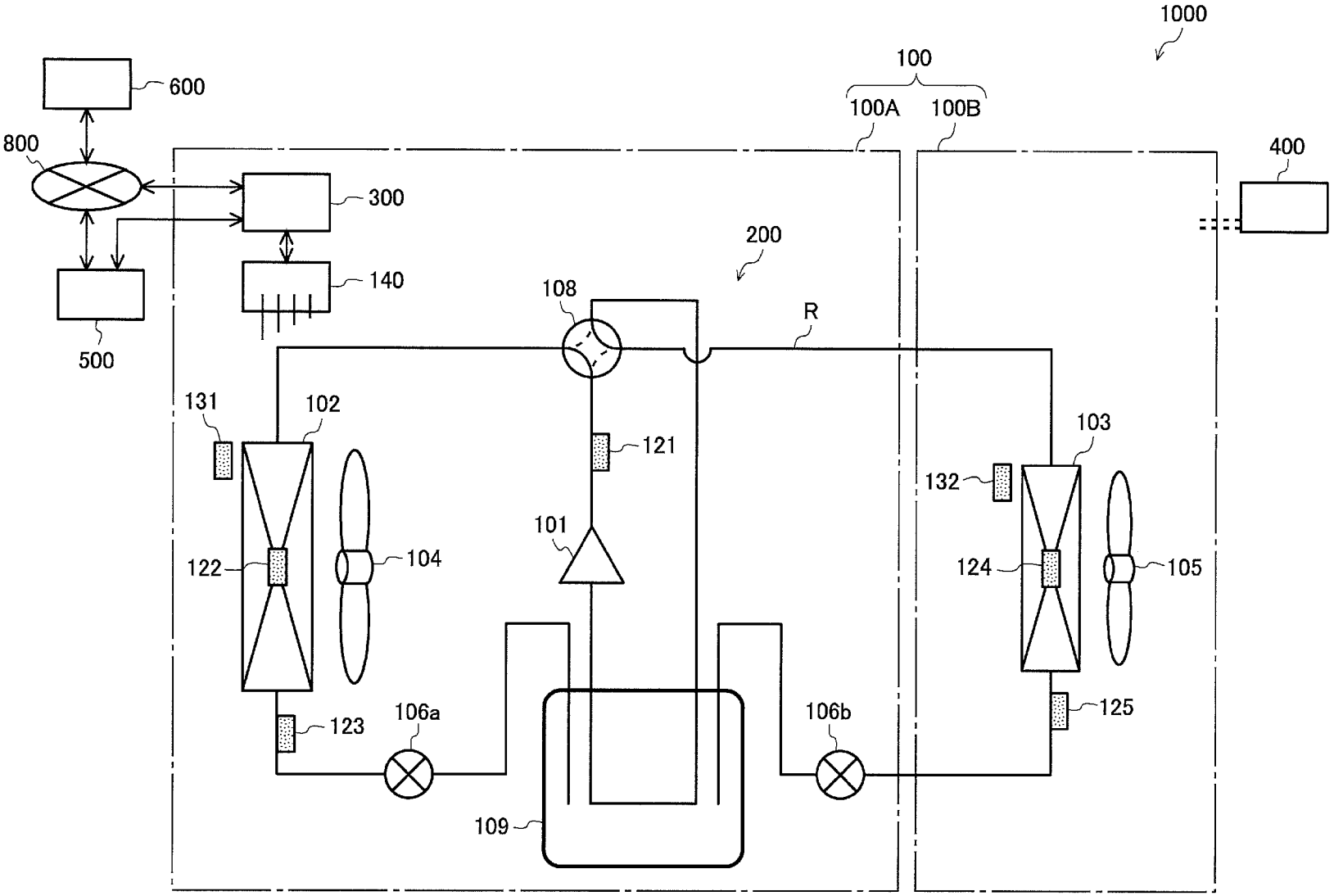
FIG. 1 a configuration diagram illustrating a state analyzer system according to Embodiment 1 of the present invention.

FIG. 1 is a configuration diagram illustrating a state analyzer system according to Embodiment 1 of the present invention. As illustrated in FIG. 1, a state analyzer system 1000 includes an air-conditioning apparatus 100, a management apparatus 400, an information terminal 500, and a server apparatus 600.

The air-conditioning apparatus 100 conditions air environments, for example, a temperature, a humidity, and cleanliness of air in an air-conditioned space such as a room. The air-conditioning apparatus 100 includes an outdoor unit 100A and an indoor unit 1006. The outdoor unit 100A includes a compressor 101, an outdoor heat exchanger 102, a first expansion valve 106*a*, a second expansion valve 106*b*, a four-way valve 108, and a receiver 109. The indoor unit 1006 includes an indoor heat exchanger 103. In other words, the air-conditioning apparatus 100 forms a refrigerant circuit 200 in which the compressor 101, the outdoor heat exchanger 102, the first expansion valve 106*a*, the receiver 109, the second expansion valve 106*b*, and the indoor heat exchanger 103 are connected to each other through a refrigerant pipe R and refrigerant circulates.

The outdoor unit 100A has an outdoor fan 104 attached to the outdoor heat exchanger 102 and promoting heat transfer of the outdoor heat exchanger 102. In Embodiment 1, the outdoor unit 100A includes a controller 140 and a state analysis device 300. The indoor unit 1006 has an indoor fan 105 attached to the indoor heat exchanger 103 and promoting heat transfer of the indoor heat exchanger 103.

Further, the air-conditioning apparatus 100 includes refrigerant temperature sensors 121 to 125 and air temperature sensors 131 to 132. The refrigerant temperature sensors 121 to 123 and the air temperature sensor 131 are provided in the outdoor unit 100A, and the refrigerant temperature sensors 124 and 125 and the air temperature sensor 132 are provided in the indoor unit 1006.

The compressor 101 is driven by, for example, an inverter and compresses sucked refrigerant and discharges it. The outdoor heat exchanger 102 is, for example, a fin-and-tube heat exchanger, and exchanges heat between air and refrigerant.

The four-way valve 108 is connected to a discharge side of the compressor 101, that is, to an outlet of the compressor 101 via the refrigerant pipe R. The four-way valve 108 switches a flow path of the refrigerant in the refrigerant circuit 200. In other words, the connection direction of the four-way valve 108 is switched by the controller 140, and the direction of the refrigerant flowing in the refrigerant circuit 200 is reversed. Thereby, a cooling operation and a heating operation can be switched.

The four-way valve 108 is in the connection direction indicated by a solid line in FIG. 1 during the cooling operation in which cooling energy is supplied to the indoor unit 1006. Therefore, during the cooling operation, the refrigerant circulates in the order of the compressor 101, the outdoor heat exchanger 102, the first expansion valve 106*a*, the receiver 109, the second expansion valve 106*b*, the indoor heat exchanger 103, and the compressor 101. At this time, the outdoor heat exchanger 102 functions as a condenser, and the indoor heat exchanger 103 functions as an evaporator.

The four-way valve 108 is in the connection direction indicated by a broken line in FIG. 1 during the heating operation in which heating energy is supplied to the indoor unit 1006. Therefore, during the heating operation, the refrigerant circulates in the order of the compressor 101, the indoor heat exchanger 103, the second expansion valve 106*b*, the receiver 109, the first expansion valve 106*a*, the outdoor heat exchanger 102, and the compressor 101. At this time, the indoor heat exchanger 103 functions as a condenser, and the outdoor heat exchanger 102 functions as an evaporator.

The first expansion valve 106*a* and the second expansion valve 106*b* are, for example, electronic expansion valves, and decompress the refrigerant to expand it. The first expansion valve 106*a* has one end connected to the outdoor heat exchanger 102 and the other end connected to the receiver 109. The second expansion valve 106*b* has one end connected to the receiver 109 and the other end connected to the indoor heat exchanger 103.

The receiver 109 temporarily stores liquid refrigerant. The receiver 109 is connected to the first expansion valve 106*a* and the second expansion valve 106*b* via the refrigerant pipe R. In addition, a part of the refrigerant pipe R, through which an inlet of the compressor 101 and the four-way valve 108 are connected to each other, passes through the inside of the receiver 109. Therefore, the refrigerant flowing through the refrigerant pipe R located in the receiver 109 exchanges heat with the refrigerant around the refrigerant pipe R located in the receiver 109. The indoor heat exchanger 103 is, for example, a fin-and-tube heat exchanger, and exchanges heat between the air and the refrigerant.

The refrigerant temperature sensor 121 is provided at the discharge side of the compressor 101 and measures a temperature of the refrigerant discharged from the compressor 101. The refrigerant temperature sensor 122 is provided in the refrigerant pipe R between the outdoor heat exchanger 102 and the first expansion valve 106*a* and measures a temperature of the refrigerant flowing between the outdoor heat exchanger 102 and the first expansion valve 106*a*. The refrigerant temperature sensor 123 is provided in the outdoor heat exchanger 102 and measures a temperature of the refrigerant flowing through the outdoor heat exchanger 102. The refrigerant temperature sensor 124 is provided in the indoor heat exchanger 103 and measures a temperature of the refrigerant flowing through the indoor heat exchanger 103. The refrigerant temperature sensor 125 is provided in the refrigerant pipe R between the indoor heat exchanger 103 and the second expansion valve 106*b* and measures a temperature of the refrigerant flowing between the indoor heat exchanger 103 and the second expansion valve 106*b*. The air temperature sensor 131 measures an outdoor air temperature that is a temperature of the air that exchanges heat with the refrigerant flowing through the outdoor heat exchanger 102. The air temperature sensor 132 measures an indoor temperature that is a temperature of the air that exchanges heat with the refrigerant flowing through the heat exchanger 103.

The controller 140 controls each of actuators such as the compressor 101, the outdoor fan 104, the indoor fan 105, the first expansion valve 106*a*, and the second expansion valve 106*b*, based on an output from the refrigerant temperature sensors 121 to 125 and the air temperature sensors 131 and 132. In addition, the controller 140 outputs control data indicating the content of control for each actuator to the state analysis device 300. In Embodiment 1, the state analysis device 300 is installed in the air-conditioning apparatus 100 to be diagnosed.

Figure 2:
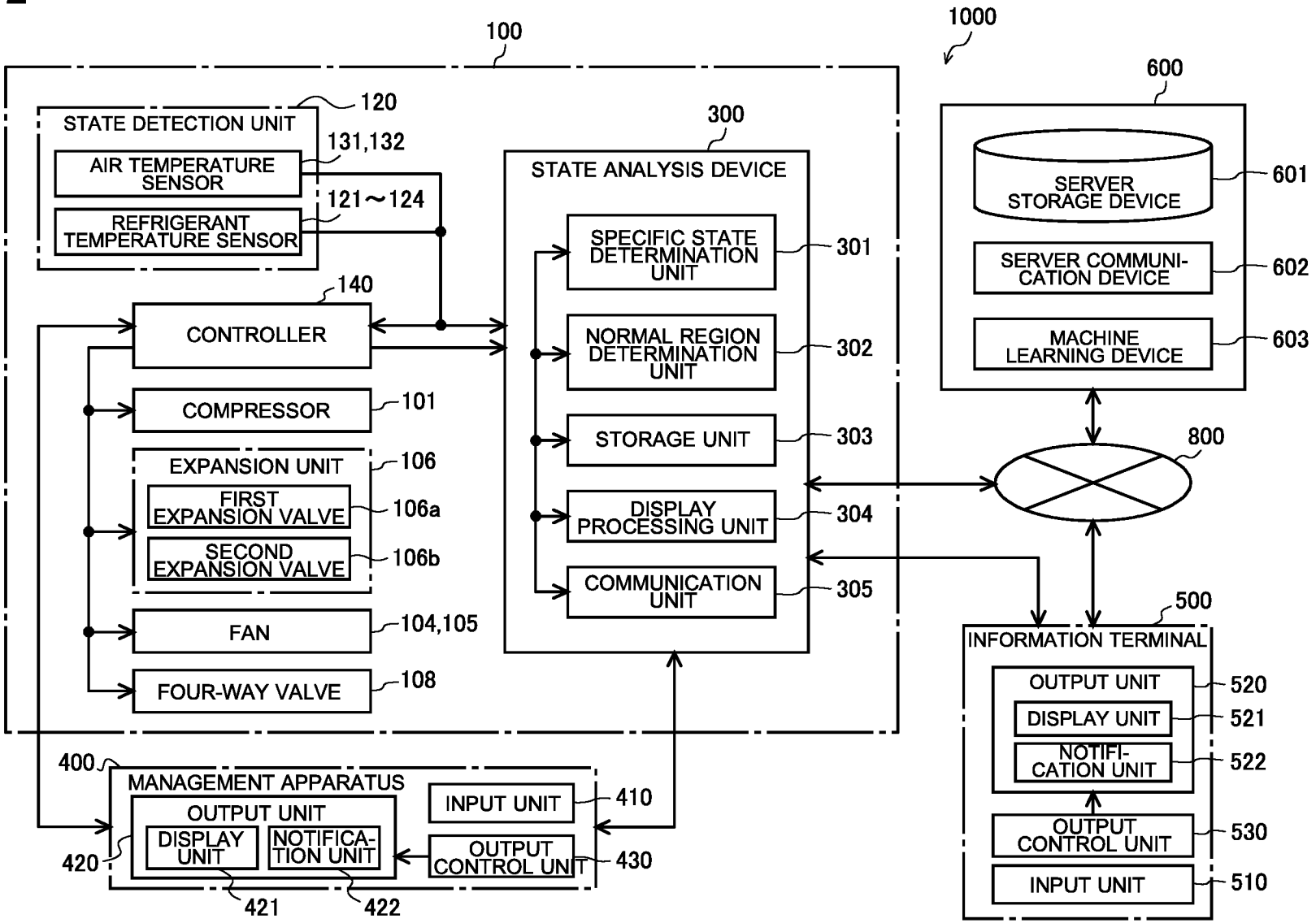
FIG. 2 is a block diagram illustrating a functional configuration of the state analyzer system illustrated in FIG. 1.

FIG. 2 is a block diagram illustrating a functional configuration of the state analyzer system illustrated in FIG. 1. As illustrated in FIG. 2, the state analyzer system 1000 includes the state analysis device 300 as a main component. A state detection unit 120 detects a state of refrigerant in the refrigerant circuit 200 as state data. In Embodiment 1, the state detection unit 120 includes the refrigerant temperature sensors 121 to 125 and the air temperature sensors 131 to 132 as illustrated in FIG. 2. An expansion unit 106 includes the first expansion valve 106*a* and the second expansion valve 106*b*.

The state analysis device 300 analyzes a state of the air-conditioning apparatus using the state data and the control data detected by the state detection unit 120. In other words, the state analysis device 300 analyzes the state of the air-conditioning apparatus 100 based on various data included in the signals sent from the controller 140, the refrigerant temperature sensors 121 to 125, and the air temperature sensors 131 and 132. Further, the state analysis device 300 allows at least one of a display unit 421 of the management apparatus 400 and a display unit 521 of the information terminal 500 to display the analysis result of the state of the air-conditioning apparatus.

More specifically, the state analysis device 300 includes a specific state determination unit 301, a normal region determination unit 302, a storage unit 303, a display processing unit 304, and a communication unit 305. The specific state determination unit 301 determines, using the state data and the control data, specific state information x representing a state of the refrigerant at a specific position in the refrigerant circuit 200 and being located in a state space defined by a first parameter and a second parameter. The specific state information x is defined by the first parameter and the second parameter. The state data and the control data can be stored in the storage unit 303 or a server storage device 601, as operation data of the air-conditioning apparatus 100.

In Embodiment 1, the first parameter is a pressure of the refrigerant, and the second parameter is an enthalpy. The state space corresponds to a p-h chart set on a coordinate plane whose axes are the pressure of the refrigerant and the enthalpy. In other words, the specific state information x is a point on the p-h chart given by the pressure of the refrigerant and the enthalpy. The specific state determination unit 301 can be set to determine the specific state information x corresponding to one specific position of the refrigerant circuit 200. Further, the specific state determination unit 301 can also be set to determine the specific state information x for each of a plurality of specific positions of the refrigerant circuit 200.

The normal region determination unit 302 determines, using the state data and the control data, a normal region X in the state space within which the specific state information x is present when the air-conditioning apparatus 100 operates under a normal state. Here, the operation of the air-conditioning apparatus 100 under the normal state means that the air-conditioning apparatus 100 is operating under a non-abnormality state, and is hereinafter referred to as a normal operation. In other words, the normal region X is data indicating a region within which the specific state information x is present when the air-conditioning apparatus 100 has no abnormality, that is, when each of the actuators and each of the sensors have no abnormality. In Embodiment 1, the normal region X is a region on the p-h chart. When the specific state determination unit 301 determines a plurality of pieces of specific state information x, the normal region determination unit 302 determines a normal region X corresponding to each of the plurality of pieces of specific state information x.

The storage unit 303 stores various data used for state analysis processing of the air-conditioning apparatus 100 together with an operation program for the state analysis device 300. For example, the storage unit 303 stores, as data, one or a plurality of calculation coefficients included in a determination formula used when the normal region determination unit 302 determines the specific state information x. The storage unit 303 stores data of a predetermined initial determination coefficient at the time of product shipment.

The display processing unit 304 allows at least one of the display unit 421 and the display unit 521 to display the specific state information x determined by the specific state determination unit 301 and the normal region X determined by the normal region determination unit 302. The display processing unit 304 generates display data that is used to display the specific state information x and the normal region X on the p-h chart.

A destination of the display data is preset in the state analysis device 300, and the display processing unit 304 transmits the generated display data to the destination that is set. In Embodiment 1, the destination of the display data is set to at least one of the management apparatus 400 and the information terminal 500. Accordingly, the display processing unit 304 transmits the generated display data to at least one of the management apparatus 400 and the information terminal 500 via the communication unit 305.

The communication unit 305 serves as an interface when the state analysis device 300 communicates with an external device. For example, the communication unit 305 acts as an intermediary when the specific state determination unit 301 and the normal region determination unit 302 receive the state data and the control data, respectively. Further, the communication unit 305 acts as an intermediary when the display processing unit 304 transmits the display data.

The communication unit 305 may communicate with the server apparatus 600 via the information terminal 500. In this case, the communication unit 305 may communicate with the information terminal 500 using a short-range wireless communication system such as WiFi (registered trademark) or Bluetooth (registered trademark). Then, the information terminal 500 serves as a relay device that transmits and receives a signal transmitted through a telecommunication line 800, and communicates with the server apparatus 600 connected to the telecommunication line 800.

The management apparatus 400 is connected to the air-conditioning apparatus 100 by a wired or a wireless manner, and operates and manages the air-conditioning apparatus 100. In other words, the management apparatus 400 is informationally, that is, communicably connected to the air-conditioning apparatus 100. The management apparatus 400 is a remote controller used to operate the air-conditioning apparatus 100, or a centralized management apparatus that manages an air conditioning system including the air-conditioning apparatus 100. In Embodiment 1, the management apparatus 400 is communicably connected to the controller 140 and the state analysis device 300. The management apparatus 400 is used when a user operates the air-conditioning apparatus 100. Further, the management apparatus 400 is used by the user to grasp the operating state of the air-conditioning apparatus 100.

As illustrated in FIG. 2, the management apparatus 400 includes an input unit 410, an output unit 420, and an output control unit 430. The output unit 420 includes a display unit 421 and a notification unit 422. The input unit 410 includes operation buttons and receives an operation from the user. In addition, the input unit 410 transmits an operation signal indicating the content of the operation from the user to the controller 140 or the state analysis device 300. The input unit 410 transmits a diagnosis request signal to the state analysis device 300 when being requested to diagnose the state of the air-conditioning apparatus 100.

The display unit 421 is, for example, a liquid crystal display (LCD), and has a function of displaying the specific state information x and the normal region X. The notification unit 422 includes a speaker, and outputs sound or voice. The output control unit 430 allows the display unit 421 to display a diagnostic image including the specific state information x and the normal region X, based on the display data transmitted from the state analysis device 300. Here, it is assumed that an image display program used to display the diagnostic image based on the display data is installed in the management apparatus 400. In Embodiment 1, when the display data is transmitted from the display processing unit 304, the output control unit 430 allows the display unit 421 to display the diagnostic image in which the specific state information x and the normal region X are displayed on the p-h chart.

The information terminal 500 is a communication terminal such as a mobile phone, a smartphone, a tablet PC (personal computer), a note PC, or a desktop PC. In other words, the information terminal 500 is informationally, that is, communicably connected to the air-conditioning apparatus 100. As illustrated in FIG. 2, the information terminal 500 includes an input unit 510, an output unit 520, and an output control unit 530. The output unit 520 includes a display unit 521 and a notification unit 522. The input unit 510 includes operation buttons and receives an operation from the user. In addition, the input unit 510 transmits an operation signal indicating the content of the operation from the user to the state analysis device 300. The input unit 510 transmits a diagnosis request signal to the state analysis device 300 when being requested to diagnose the state of the air-conditioning apparatus 100.

The display unit 521 is, for example, a liquid crystal display, and has a function of displaying the specific state information x and the normal region X. The notification unit 522 includes a speaker, and outputs sound or voice. The output control unit 530 allows the display unit 521 to display a diagnostic image including the specific state information x and the normal region X, based on the display data transmitted from the state analysis device 300. Here, it is assumed that an image display program used to display the diagnostic image based on the display data is installed in the information terminal 500. In Embodiment 1, when the display data is transmitted from the display processing unit 304, the output control unit 530 allows the display unit 521 to display the diagnostic image in which the specific state information x and the normal region X are displayed on the p-h chart.

The server apparatus 600 is, for example, a storage processing apparatus that is disposed outside the air-conditioning apparatus 100 and is provided by a cloud service. The server apparatus 600 is communicably connected to the information terminal 500 and the state analysis device 300 via the telecommunication line 800 that is a network such as the Internet. The server apparatus 600 serves as a database that stores and accumulates various data such as the analysis result obtained by the state analysis device 300. In addition, the server apparatus 600 has a function of processing various arithmetic operations based on the stored data.

The server apparatus 600 includes a server storage device 601, a server communication device 602, and a machine learning device 603. The server communication device 602 functions as an interface when the devices such as the machine learning device 603 and the server storage device 601 in the server apparatus 600 communicates with the external apparatus of the server apparatus 600 via the telecommunication line 800 and performs signal conversion. The server storage device 601 stores the state data, the control data, and the determination coefficient included in the determination formula used by the normal region determination unit 302.

The machine learning device 603 is a device in which input data is processed by machine learning. The machine learning is an approach of sequentially acquiring new knowledge and skills and reconstructing existing knowledge and skills to extract useful rules and judgement criteria. In Embodiment 1, the machine learning device 603 calculates a determination coefficient for the normal region determination unit 302 to determine the normal region X from the state data and the control data measured by each of the sensors and the analysis result from the state analysis device 300.

By the way, the normal region determination unit 302 may continuously use the initial determination coefficient, but may rewrite and update the data of the determination coefficient using the machine learning device 603. For example, the machine learning device 603 may determine the determination coefficient over time by processing based on machine learning, using various data relating to the operation of the air-conditioning apparatus 100 in normal and abnormal states as an input. Then, the determination coefficient determined by the machine learning device 603 may be sent from the server apparatus 600 to the state analysis device 300, and the determination coefficient in the storage unit 303 may be rewritten and updated. Thereby, a more appropriate normal region X can be determined, so that the accuracy of the information displayed on the display unit 421 or 521 is increased, and thus the accuracy in diagnosis of the user can be improved.

Figure 3:
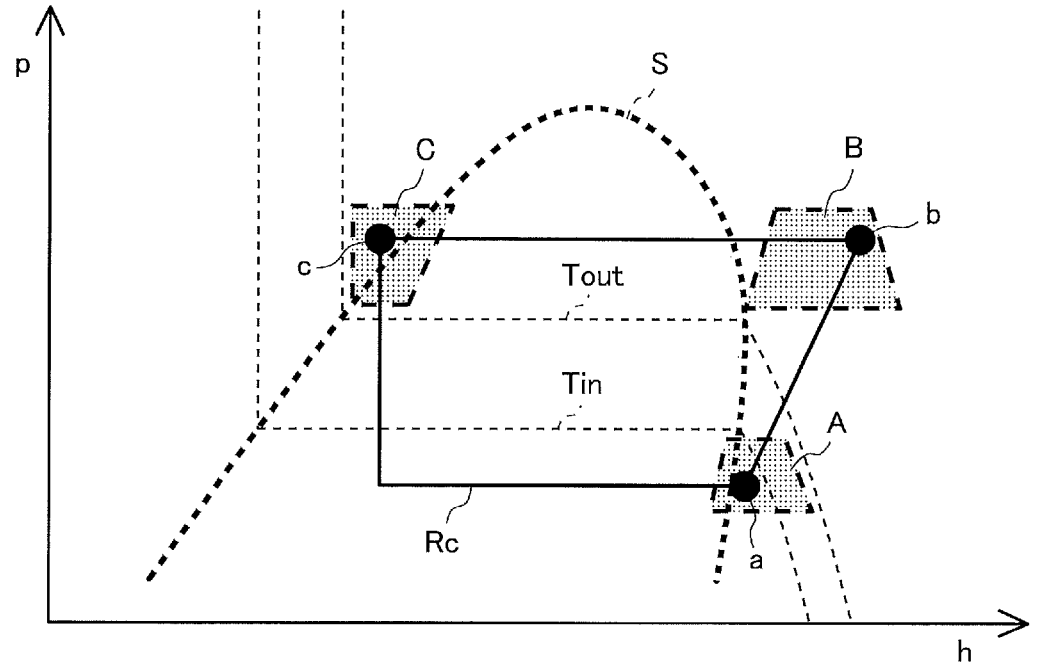
FIG. 3 is an explanatory diagram illustrating a display example of specific state information and a normal region according to Embodiment 1 of the present invention when an air-conditioning apparatus is in a normal state.

FIG. 3 is an explanatory diagram illustrating a display example of the specific state information and the normal region in Embodiment 1 of the present invention when the air-conditioning apparatus is in the normal state. In FIG. 3, the specific state information x and the normal region X are displayed on the p-h chart. Further, FIG. 3 illustrates a saturation line S including a saturated liquid line and a saturated vapor line, a refrigeration cycle chart Rc, an isothermal line Tout corresponding to an outdoor temperature, and an isothermal line Tin corresponding to an indoor temperature.

Here, FIG. 3 illustrates an example in which the specific state determination unit 301 determines the specific state information x for each of three specific positions in the refrigerant circuit 200 and the normal region determination unit 302 determines the normal region X corresponding to each of three pieces of specific state information x. Accordingly, three pieces of specific state information x are present, and the three pieces of specific state information x are determined by the states of the refrigerant at the three specific positions of the refrigerant circuit 200, respectively.

In addition, the three specific positions are an inlet of the compressor 101, an outlet of the compressor 101, and an outlet of the condenser. In other words, the three pieces of specific state information x includes inlet information "a" indicating the state of the refrigerant at the inlet of the compressor 101, outlet information "b" indicating the state of the refrigerant at the outlet of the compressor 101, and condensation information "c" indicating the state of the refrigerant at the outlet of the condenser. In other words, the normal region determination unit 302 determines the inlet information "a", the outlet information "b", and the condensation information "c" that are the three pieces of specific state information x.

Three normal regions X are determined according to the inlet information "a", the outlet information "b", and the condensation information "c" that are the three pieces of specific state information x. The three normal regions X includes an inlet region A where the inlet information "a" is present during the normal operation, an outlet region B where the outlet information "b" is present during the normal operation, and a condensation region C where the condensation information "c" is present during the normal operation. In other words, the specific state determination unit 301 determines the inlet region A, the outlet region B, and the condensation region C that are the three normal regions X corresponding to the three pieces of specific state information x, respectively.

In the display example illustrated in FIG. 3, the user can visually confirm that the specific state information x is within the normal region X and determine that the air-conditioning apparatus 100 has no abnormality. In FIG. 3, the isothermal line Tout corresponding to the outdoor temperature and the isothermal line Tin corresponding to the indoor temperature may not be displayed. However, when the isothermal line Tout and the isothermal line Tin are displayed on the diagnostic image, the user can visually grasp the relationship between the state of the air-conditioning apparatus 100 and the air temperature around the air-conditioning apparatus 100.

Figure 4:
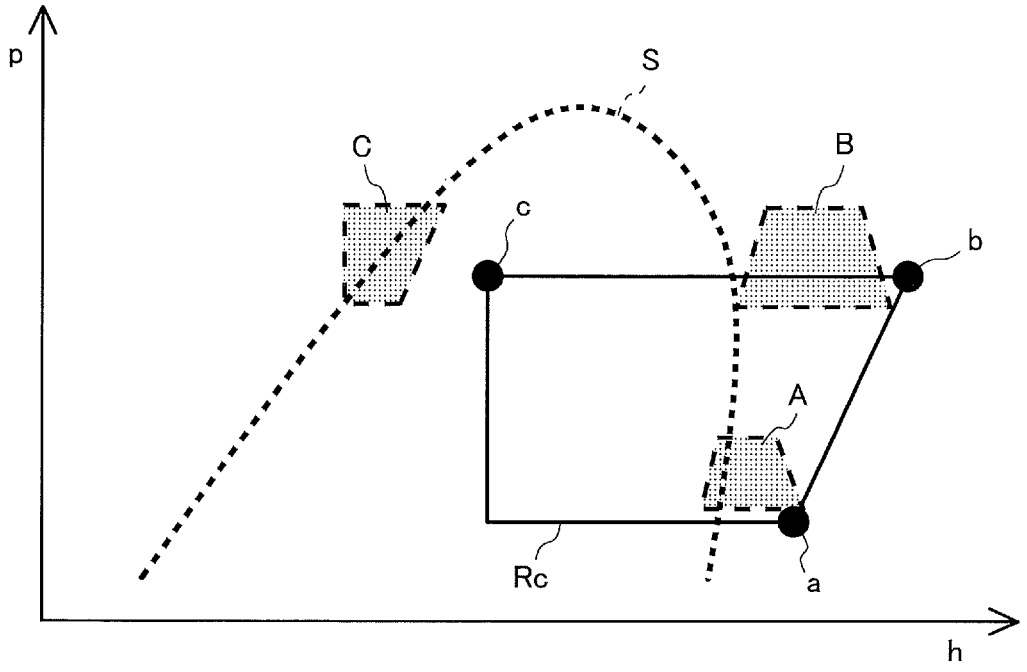
FIG. 4 is an explanatory diagram illustrating a display example of specific state information and a normal region according to Embodiment 1 of the present invention when an abnormality in the amount of refrigerant is suspected.
Figure 5:
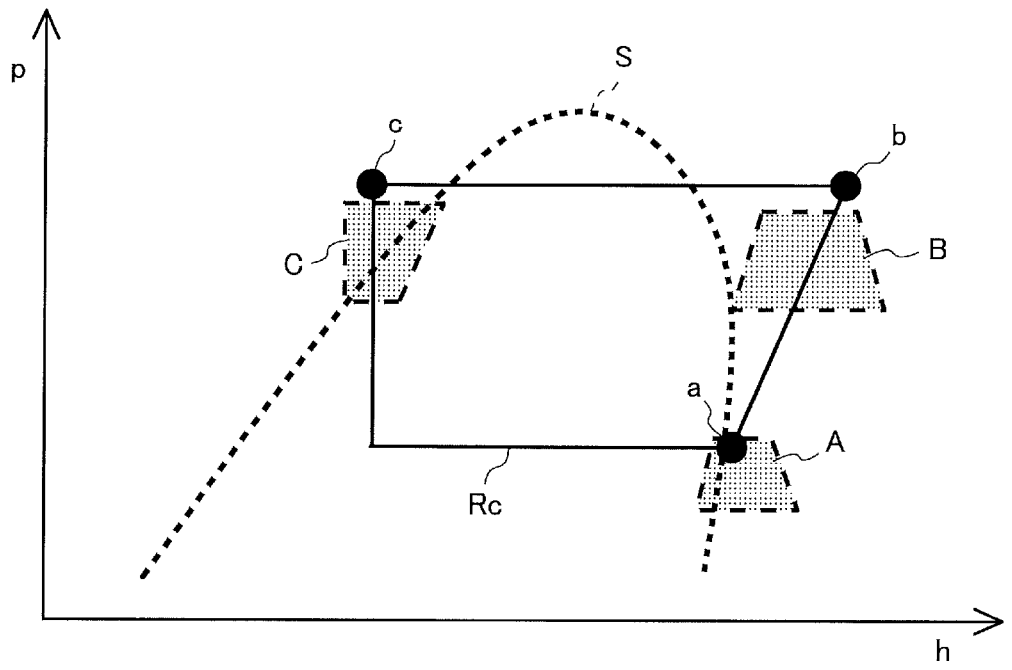
FIG. 5 is an explanatory diagram illustrating a display example of specific state information and a normal region in Embodiment 1 of the present invention when an abnormality in heat transfer in a condenser is suspected.
Figure 6:
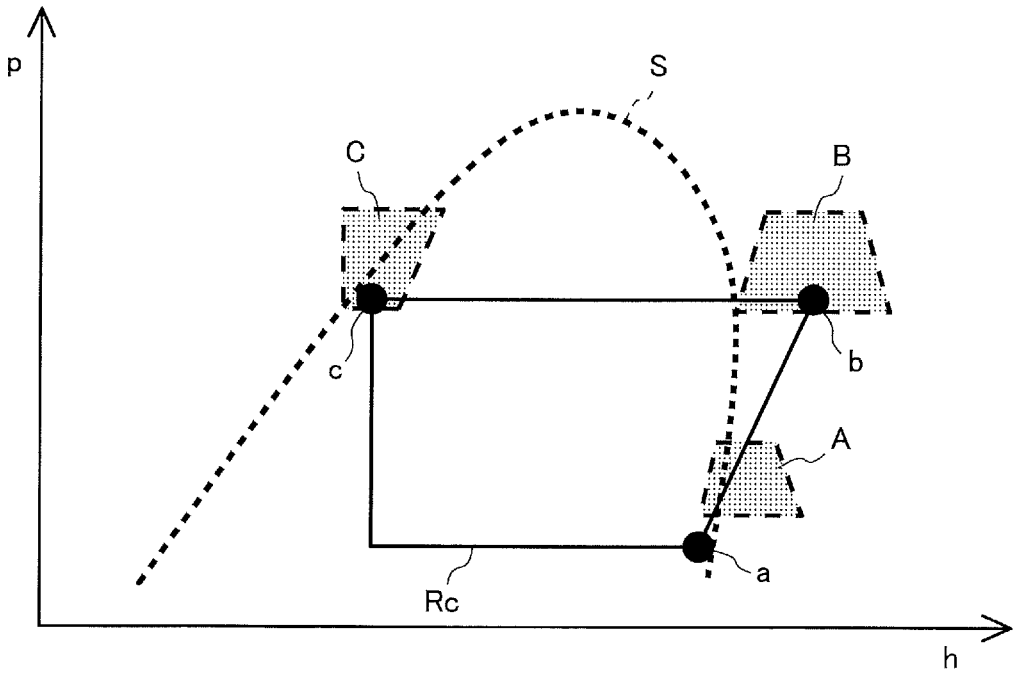
FIG. 6 is an explanatory diagram illustrating a display example of specific state information and a normal region in Embodiment 1 of the present invention when an abnormality in heat transfer in an evaporator is suspected.
Figure 7:
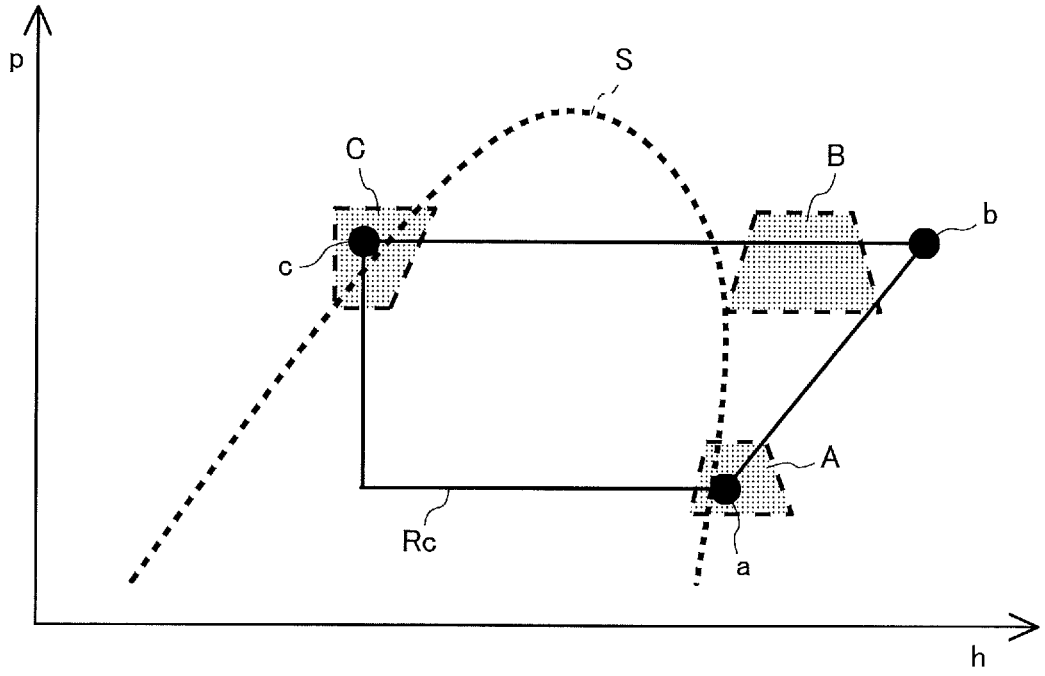
FIG. 7 is an explanatory diagram illustrating a display example of specific state information and a normal region in Embodiment 1 of the present invention when an abnormality in a compressor is suspected.
Figure 8:
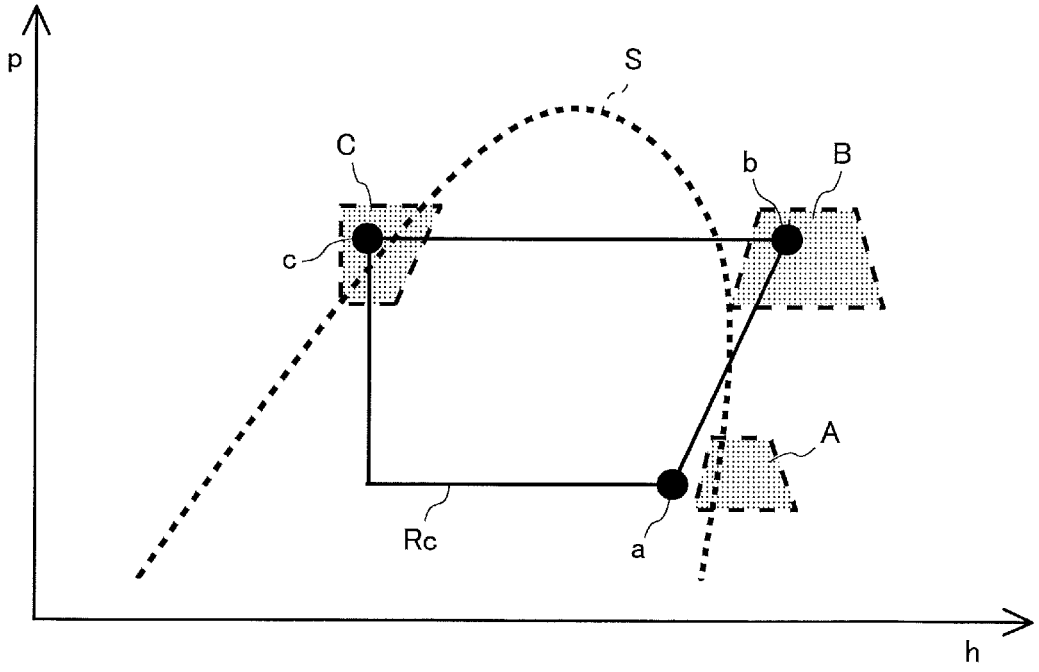
FIG. 8 is an explanatory diagram illustrating a display example of specific state information and a normal region in Embodiment 1 of the present invention when an abnormality in which the compressor is compressing liquid refrigerant is suspected.
Figure 9:
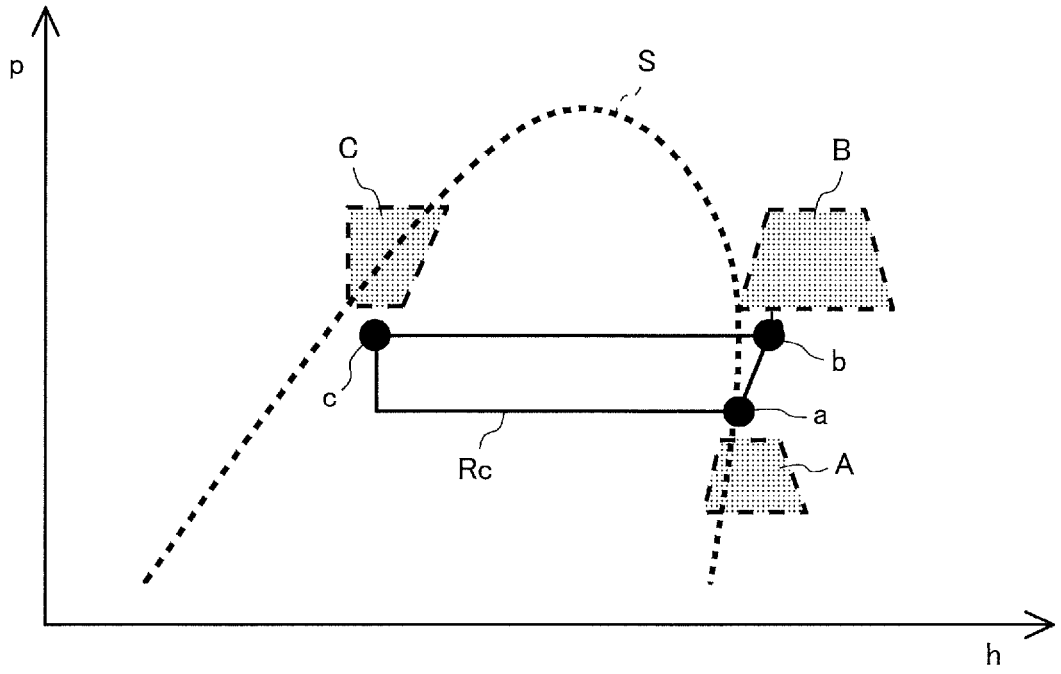
FIG. 9 is an explanatory diagram illustrating a display example of specific state information and a normal region in Embodiment 1 of the present invention when an abnormality in an expansion unit or pipe clogging is suspected.

Next, a description will be given with respect to a display example when the air-conditioning apparatus 100 has an abnormality. FIG. 4 is an explanatory diagram illustrating a display example of the specific state information and the normal region in Embodiment 1 of the present invention when an abnormality in the amount of refrigerant is suspected. FIG. 5 is an explanatory diagram illustrating a display example of the specific state information and the normal region in Embodiment 1 of the present invention when an abnormality in heat transfer in the condenser is suspected. FIG. 6 is an explanatory diagram illustrating a display example of the specific state information and the normal region in Embodiment 1 of the present invention when an abnormality in heat transfer in the evaporator is suspected. FIG. 7 is an explanatory diagram illustrating a display example of the specific state information and the normal region in Embodiment 1 of the present invention when an abnormality in the compressor is suspected. FIG. 8 is an explanatory diagram illustrating a display example of the specific state information and the normal region in Embodiment 1 of the present invention when an abnormality in which the compressor is compressing the liquid refrigerant is suspected. FIG. 9 is an explanatory diagram illustrating a display example of the specific state information and the normal region in Embodiment 1 of the present invention when an abnormality in the expansion unit or pipe clogging is suspected. In FIGS. 4 to 9, the specific state information x and the normal region X are displayed on the p-h chart. Further, FIGS. 4 to 9 illustrate the saturation line S and the refrigeration cycle chart Rc as illustrated in FIG. 3. A method of identifying a factor of the abnormality in the air-conditioning apparatus 100 will be described with reference to FIGS. 4 to 9.

When the abnormality in the amount of refrigerant is suspected, the condensation information "c" has higher enthalpy than the condensation region C as illustrated in FIG. 4. Therefore, the user can visually recognize, from the display example illustrated in FIG. 4, that the condensation information "c" deviates to the right from the condensation region C, thereby recognizing that the abnormality in the amount of refrigerant is suspected.

When the abnormality in heat transfer in the condenser is suspected, the outlet information "b" has a higher pressure than the outlet region B and the condensation information "c" has a higher pressure than the condensation region C, as illustrated in FIG. 5. Therefore, the user can visually recognize, from the display example illustrated in FIG. 5, that the outlet information "b" deviates above the outlet region B and the condensation information "c" deviates above the condensation region C, thereby recognizing that the abnormality in heat transfer in the condenser is suspected. Here, it is assumed that the abnormality in heat transfer in the condenser depends on an abnormality in the outdoor heat exchanger 102 or an operation abnormality in the outdoor fan 104 during the cooling operation or an abnormality in the indoor heat exchanger 103 or an operation abnormality in the indoor fan 105 during the heating operation.

When the abnormality in heat transfer in the evaporator is suspected, the inlet information "a" has a lower pressure than the inlet region A as illustrated in FIG. 6. Therefore, the user can visually recognize, from the display example illustrated in FIG. 6, that the inlet information "a" deviates below the inlet region A, thereby recognizing that the abnormality in heat transfer in the evaporator is suspected. Here, it is assumed that the abnormality in heat transfer in the evaporator depends on an abnormality in the indoor heat exchanger 103 or an operation abnormality in the indoor fan 105 during the cooling operation or an abnormality in the outdoor heat exchanger 102 or an operation abnormality in the outdoor fan 104 during the heating operation.

When the abnormality in the compressor 101 is suspected, the outlet information "b" has higher enthalpy than the outlet region B as illustrated in FIG. 7. Therefore, the user can visually recognize, from the display example illustrated in FIG. 7, that the outlet information "b" deviates to the right from the outlet region B, thereby recognizing that the abnormality in the compressor 101 is suspected.

When it is suspected that the compressor 101 is compressing the liquid refrigerant, the inlet information "a" has lower enthalpy than the inlet region A as illustrated in FIG. 8. Therefore, the user can visually recognize, from the display example illustrated in FIG. 8, that the inlet information "a" deviates to the left from the inlet region A, thereby recognizing that the liquid refrigerant is suspected to have flowed into the compressor 101.

When the abnormality in the expansion unit 106 or the pipe clogging is suspected, the inlet information "a" has a higher pressure than the inlet region A, the outlet information "b" has a lower pressure than the outlet region B, and the condensation information "c" has a lower pressure than the condensation region C, as illustrated in FIG. 9. Therefore, the user can visually recognize, from the display example illustrated in FIG. 9, that the inlet information "a" deviates above the inlet region A, the outlet information "b" deviates below the outlet region B, and the condensation information "c" deviates below the condensation region C, thereby recognizing that the abnormality in the expansion unit 106 or the pipe clogging is suspected. In Embodiment 1, the abnormality in the expansion unit 106 means that at least one of the first expansion valve **106*a* and the second expansion valve 106*b* has an abnormality. In addition, the pipe clogging is a situation in which the refrigerant circuit 200** has a clogging portion that hinders the circulation of the refrigerant.

As described above, the user can diagnose the state of the air-conditioning apparatus 100 based on the specific state information x and the normal region X displayed on the p-h chart. In other words, the user grasps the relationship between the position of the specific state information x with respect to the normal region X and the factor of the abnormality in the air-conditioning apparatus 100, and thus can diagnose the factor of the abnormality and the degree of deterioration of the air-conditioning apparatus 100 from the diagnostic image at a glance.

In the examples illustrated in FIGS. 3 to 9, the display unit 421 or the display unit 521 displays, as the specific state information x, the inlet information "a", the outlet information "b", and the condensation information "c", and displays, as the normal region X, the inlet region A, the outlet region B, and the condensation region C. Accordingly, the user can visually recognize the diagnostic image, thereby diagnosing the abnormality in the amount of refrigerant enclosed in the refrigerant circuit 200, the abnormality in the condenser or the evaporator, the abnormality in the compressor 101, the abnormality in which the liquid refrigerant flows into the compressor 101, the abnormality in the expansion unit 106, the abnormality in which the refrigerant circuit 200 has the clogging portion, and the operation abnormality in at least one of the outdoor fan 104 and the indoor fan 105. Then, when the abnormality has occurred in the air-conditioning apparatus 100, the user can easily identify the factor of the abnormality.

Although FIGS. 3 to 9 exemplify the cases where the diagnostic image includes the saturation line S, the diagnostic image may not include the saturation line S without being limited thereto. Further, FIGS. 3 to 9 exemplify the cases where the diagnostic image is displayed including the refrigeration cycle chart Rc, but the diagnostic image may not include the refrigeration cycle chart Rc without being limited thereto. However, when the diagnostic image includes the refrigeration cycle chart Rc, the specific state information x and the normal region X can be more easily associated with each other, so that the convenience of the user can be improved.

Here, the controller 140 and the state analysis device 300 can include hardware such as a circuit device that realizes the respective functions described above or an arithmetic device such as a microcomputer and software that realizes the respective functions described above in cooperation with such an arithmetic device. The storage unit 303 can include a random access memory (RAM) and a read only memory (ROM), a programmable ROM (PROM) such as a flash memory, or a hard disk drive (HDD), for example.

Figure 10:
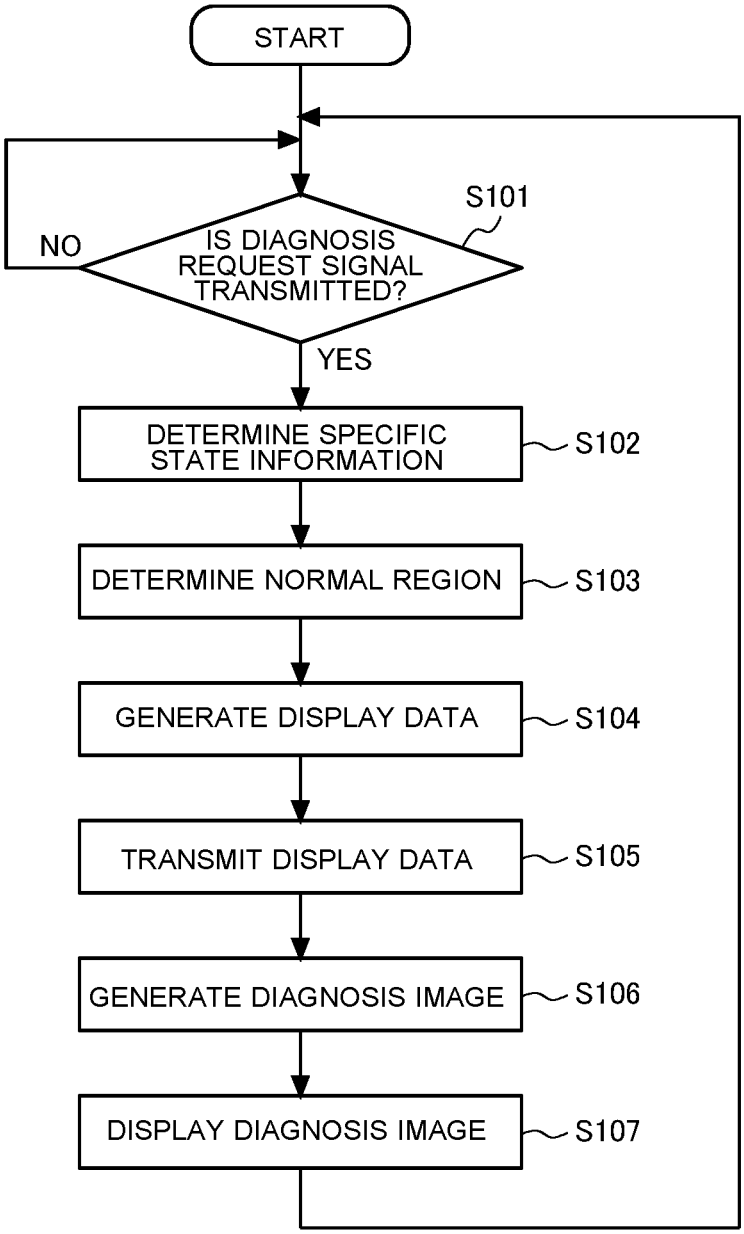
FIG. 10 is a flowchart illustrating an operation of the state analyzer system illustrated in FIGS. 1 and 2.

FIG. 10 is a flowchart illustrating the operation of the state analyzer system illustrated in FIGS. 1 and 2. A state analysis method of the air-conditioning apparatus 100 in Embodiment 1 will be described with reference to FIG. 10. Here, a description will be given with respect to a case where a diagnostic image based on display data is displayed on the display unit 521 of the information terminal 500.

The state analysis device 300 waits until a diagnosis request signal is transmitted from the management apparatus 400 or the information terminal 500 (NO in step S101). When the diagnosis request signal is transmitted (YES in step S101), the state analysis device 300 uses the specific state determination unit 301 to determine the current specific state information x (step S102). Next, the state analysis device 300 uses the normal region determination unit 302 to determine the current normal region X (step S103).

Subsequently, the state analysis device 300 uses the display processing unit 304 to generate display data that is the origin of the diagnostic image in which the specific state information x and the normal region X are displayed on the p-h chart (step S104), and to transmit the generated display data to the information terminal 500 (step S105). Then, the information terminal 500 uses the output control unit 530 to generate information on the diagnostic image based on the display data transmitted from the state analysis device 300 (step S106), and to allow the display unit 521 to display the diagnostic image including the specific state information x and the normal region X (step S107). Then, the operation of the state analyzer system 1000 proceeds to the process of step S101.

The information terminal 500 displays the diagnostic image on the display unit 521, and then switches the diagnostic image displayed on the display unit 521 to a home screen when the user performs an operation of switching an image or when a certain period of time has elapsed. Since the diagnostic image is displayed on the display unit 421 of the management apparatus 400 in the same manner as the above operation, the description thereof will not be presented.

As described above, since the state analysis device 300 and the state analyzer system 1000 in Embodiment 1 display the specific state information x and the normal region X, the user can visually recognize the position of the specific state information x with respect to the normal region X. Therefore, the user can easily diagnose the factor of abnormality and the degree of deterioration of the air-conditioning apparatus. In other words, the state analyzer system 1000 displays the specific state information x and the normal region X on the p-h chart. Accordingly, the user can grasp the position of the specific state information x with respect to the normal region X on the p-h chart at a glance, and can obtain a highly accurate diagnosis result.

In addition, the state analysis device 300 can determine the specific state information x for each of the plurality of specific positions in the refrigerant circuit 200 and the normal region X corresponding to each of the pieces of specific state information x. Then, since the state analysis device 300 and the state analyzer system 1000 display the plurality pieces of specific state information x and the plurality of normal regions X, it is possible to easily and accurately identify the factor of the abnormality. By the way, in the conventional configuration, the user needs to acquire specialized knowledge, for example, the degree of influence for each factor of the abnormality to accurately identify the factor of the abnormality in the air-conditioning apparatus 100. In this regard, according to the state analyzer system 1000, the positional relationship between the specific state information x and the normal region X is clearly associated with the factor of the abnormality in the air-conditioning apparatus 100, as described above. Therefore, the user can diagnose the air-conditioning apparatus 100 with high accuracy without having specialized knowledge, that is, the user can know the deterioration state of the air-conditioning apparatus 100 and the necessity of maintenance at a glance, so that the convenience of the user can be improved.

Further, the display unit 421 or the display unit 521 can display the isothermal line indicating the temperature of the environment in which the air-conditioning apparatus 100 is installed, together with the specific state information x and the normal region X. In this case, the use can visually grasp the relationship between the state of the air-conditioning apparatus 100 and the air temperature around the air-conditioning apparatus 100, so that the ease of diagnosis can be increased.

The normal region determination unit 302 may determine the normal region X by further using information on design specifications of the air-conditioning apparatus 100. In this way, the normal region X can be more appropriately determined, and the accuracy of the information displayed on the display unit is increased, so that the user can diagnose with high accuracy.

<Modification 1>

Figure 11:
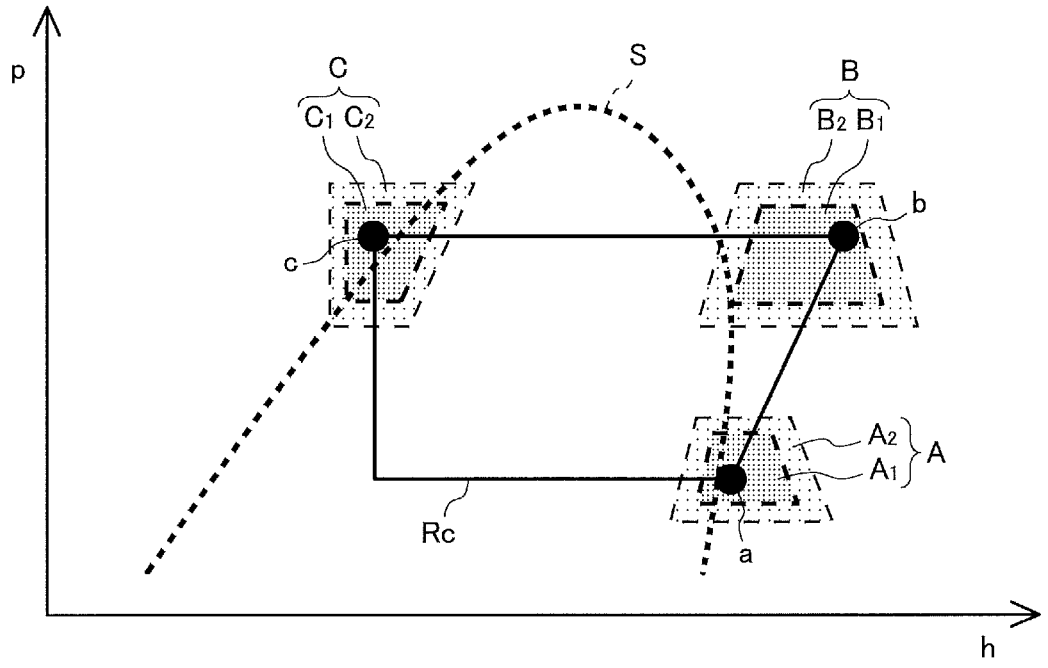
FIG. 11 is an explanatory diagram illustrating a display example of specific state information and a normal region according to Modification 1 of Embodiment 1 of the present invention.

FIG. 11 is an explanatory diagram illustrating a display example of specific state information and a normal region according to Modification 1 of Embodiment 1 of the present invention. In the above description, the normal region X is configured in one level, but the normal region X in a diagnostic image is divided into a plurality of levels depending on the degree of normality of the air-conditioning apparatus 100 in Modification 1. In other words, the normal region determination unit 302 of Modification 1 divides the normal region X into levels depending on the degree of normality of the air-conditioning apparatus 100. In the normal region X, the degree of normality decreases from the center toward the outside. In other words, the degree of abnormality in the normal region X increases from the center toward the outside.

A basic configuration of FIG. 11 is the same as those of FIGS. 3 to 9, and the normal region X is divided into two levels in FIG. 11. In this case, the normal region determination unit 302 determines an inlet region A formed by a first inlet region $A_1$ and a second inlet region $A_2$, an outlet region B formed by a first outlet region $B_1$ and a second outlet region $B_2$, and a condensation region C formed by a first condensation region $C_1$ and a second condensation region $C_2$.

In the inlet region A, the second inlet region $A_2$ is less normal than the first inlet region $A_1$. In the outlet region B, the second outlet region $B_2$ is less than the first outlet region $B_1$. In the condensation region C, the second condensation region $C_2$ is less normal than the first condensation region $C_1$.

The display processing unit 304 generates display data using the normal region X divided into two levels. Therefore, the output control unit 430 can allow the display unit 421 to display the diagnostic image including the normal region X divided into two levels, as illustrated in FIG. 11. Similarly, the output control unit 530 can allow the display unit 521 to display the diagnostic image including the normal region X divided into two levels.

The normal region X may be divided into three or more levels. In other words, the normal region determination unit 302 may determine the normal region X divided into three or more levels, and the display processing unit 304 may generate display data using the normal region X divided into three or more levels. Thereby, the output control unit 430 can allow the display unit 421 to display a diagnostic image including the normal region X divided into three or more levels. Similarly, the output control unit 530 can allow the display unit 521 to display the diagnostic image including the normal region X divided into three or more levels.

As described above, the state analysis device 300 and the state analyzer system 1000 in Modification 1 provide the normal region in the form of the levels of a plurality of layers depending on the degree of normality thereof, and thus display the normal region X divided into two or more levels.

Therefore, the user can diagnose the state of the air-conditioning apparatus 100 in detail. In other words, according to the state analyzer system 1000 in Modification 1, the user can more easily diagnose the degree of deterioration of the air-conditioning apparatus 100, and thus can determine the necessity of maintenance with higher accuracy.

In the above description, all of the inlet region A, the outlet region B, and the condensation region C are divided into two or more levels, but one or two of the inlet region A, the outlet region B, and the condensation region C may be divided into two or more levels without being limited thereto. In other words, when a plurality of specific positions are set, at least one normal region X may be divided into two or more levels.

<Modification 2>

Figure 12:
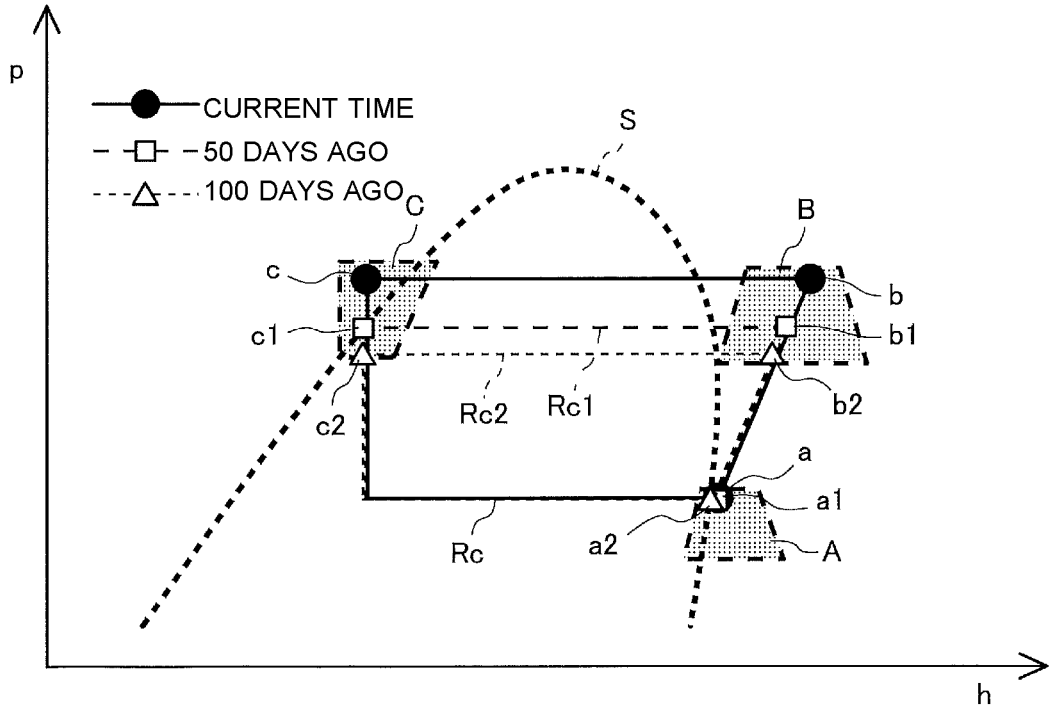
FIG. 12 is an explanatory diagram illustrating a display example of specific state information and a normal region according to Modification 2 of Embodiment 1 of the present invention.

FIG. 12 is an explanatory diagram illustrating a display example of specific state information and a normal region according to Modification 2 of Embodiment 1 of the present invention. In the above description, the display unit 421 or the display unit 521 displays only the current specific state information x, but the display unit 421 or the display unit 521 may display information indicating a secular change of the specific state information x without being limited thereto. In other words, a display processing unit 304 may generate display data including not only the current specific state information x but also the past specific state information x. In this case, the current and past specific state information x may be accumulated in the storage unit 303 or the server storage device 601.

More specifically, the specific state determination unit 301 allows the storage unit 303 or the server storage device 601 to accumulate the specific state information x determined using the state data and the control data in time series for at least a certain period of the past. Here, the certain period can be set according to the configuration and installation environment of the air-conditioning apparatus 100, and can be changed as appropriate.

The display processing unit 304 extracts the current specific state information x and the past specific state information x from the plurality of pieces of specific state information x accumulated in the storage unit 303 or the server storage device 601. Then, the display processing unit 304 generates display data using the past specific state information x together with the current specific state information x. Accordingly, the display unit 421 or the display unit 521 can display the past specific state information x that is information indicating the secular change of the specific state information x.

In the display example illustrated in FIG. 12, the display processing unit 304 is configured to extract specific state information x at a period that is traced back by a reference period from the current time and specific state information x at a period that is further traced back by the reference period therefrom. In FIG. 12, the reference period is set to 50 days.

More specifically, in the display example illustrated in FIG. 12, the display processing unit 304 extracts, from the storage unit 303 or the server storage device 601, inlet information "a", inlet information a1 that is inlet information "a" on 50 days before the current time, and inlet information a2 that is inlet information "a" on 100 days before the current time. In addition, the display processing unit 304 extracts outlet information "b", outlet information b1 that is outlet information "b" on 50 days before the current time, and outlet information b2 that is outlet information "b" on 100 days before the current time. Further, the display processing unit 304 extracts condensation information "c", condensation information c1 that is condensation information "c" on 50 days before the current time, and condensation information c2 that is condensation information "c" on 100 days before the current time.

Then, the display processing unit 304 generates display data using the extracted information. Therefore, the state analysis device 300 can allow the display unit to display a diagnostic image including the inlet information a1 and a2, the outlet information b1 and b2, and the condensation information c1 and c2 that are information indicating the secular change of the specific state information x.

In addition, the display processing unit 304 generates display data including the past refrigeration cycle chart Rc together with the current refrigeration cycle chart Rc. In the display example illustrated in FIG. 12, the display processing unit 304 generates display data including the refrigeration cycle chart Rc, a refrigeration cycle chart Rc1 that is a refrigeration cycle chart Rc on 50 days before the current time, and a refrigeration cycle chart Rc2 that is a refrigeration cycle chart Rc on 100 days before the current time. Therefore, the state analysis device 300 can allow the display unit to display a diagnostic image including the refrigeration cycle chart Rc1 and the refrigeration cycle chart Rc2 that are information indicating the secular change of the specific state information x.

FIG. 12 illustrates the case where the reference period is set to 50 days, but the elapsed time can be appropriately changed without being limited thereto. In addition, FIG. 12 illustrates the case where the past two pieces of specific state information x are displayed, but the diagnostic image may include past three or more pieces of specific state information x without being limited thereto.

As described above, the state analysis device 300 and the state analyzer system 1000 in Modification 2 allow the display unit to display the diagnostic image including the information indicating the secular change of the specific state information x. In other words, at least one of the display unit 421 and the display unit 521 displays information indicating the secular change of the specific state information x. Accordingly, the user can grasp the secular change of the degree of deterioration of the air-conditioning apparatus 100 by visually recognizing the diagnostic image, so that the user can more accurately diagnose the state of the air-conditioning apparatus 100.

Further, the secular change of the specific state information x differs depending on the specific position corresponding to the specific state information x. For example, in the display example illustrated in FIG. 12, while the secular change of the outlet information "b" and the condensation information "c" is relatively large, the secular change of the inlet information "a" is relatively small. Here, the plurality of pieces of specific state information x correspond to different specific positions. In other words, the plurality of pieces of specific state information x serve as various indicators regarding the abnormality of the air-conditioning apparatus 100, respectively, as described with reference to FIG. 4 to FIG. 9. Therefore, the user can know the tendency of deterioration of the air-conditioning apparatus 100 from the information indicating the secular change of the specific state information x.

FIG. 12 illustrates the case where the diagnostic image is displayed including the past refrigeration cycle chart Rc together with the past and current refrigeration cycle charts Rc, but the present invention is not limited thereto. The diagnostic image may not include the past refrigeration cycle chart Rc, or may originally lack the current and past refrigeration cycle charts Rc. However, when the diagnostic image includes the refrigeration cycle chart Rc, the specific state information x and the normal region X can be more easily associated with each other, so that the tendency of the secular change of the specific state information x can be easily grasped and the convenience of the user can be improved. The configuration of Modification 2 can also be applied to the configuration of Modification 1.

Embodiment 2

Figure 13:
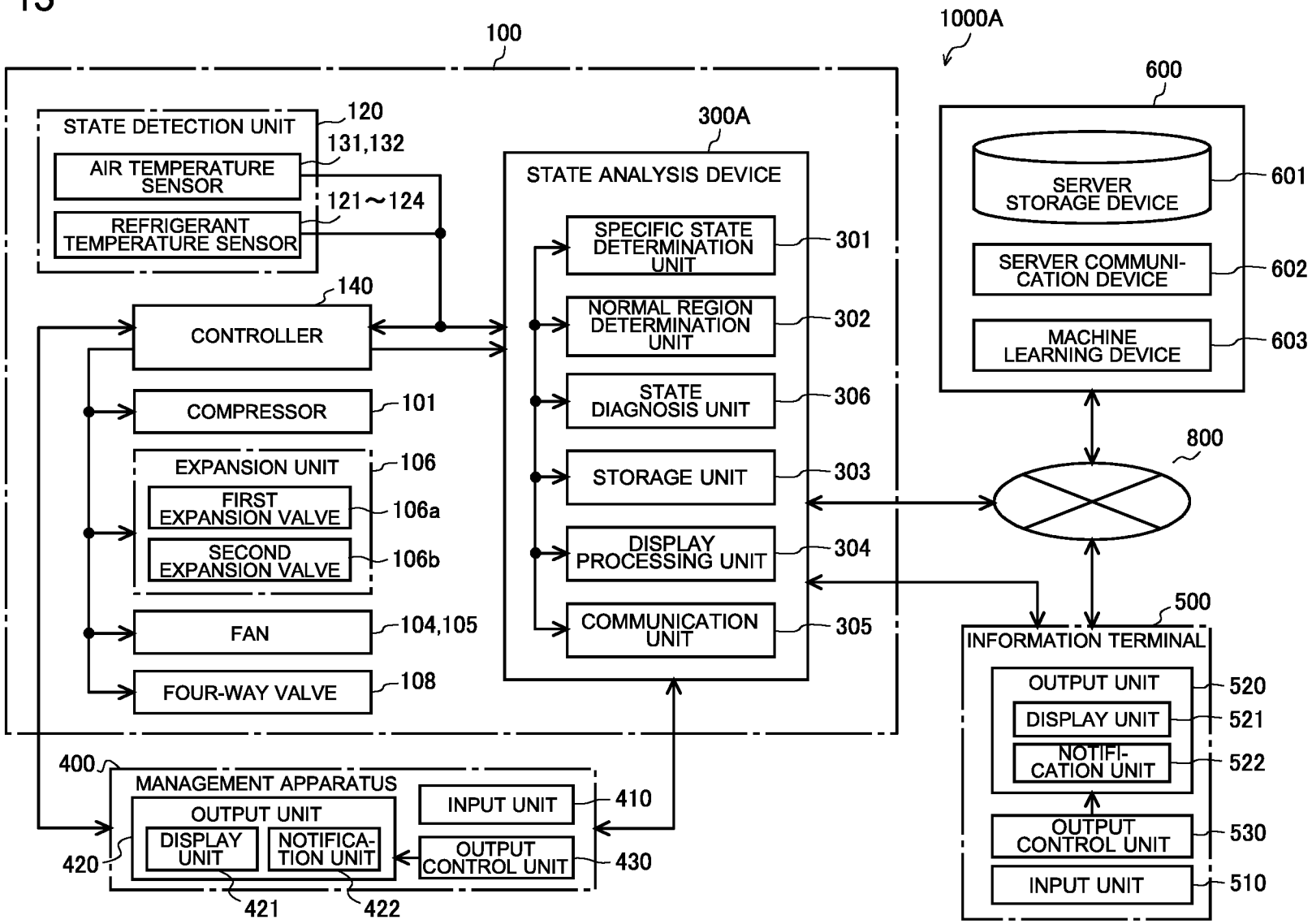
FIG. 13 is a block diagram illustrating a functional configuration of a state analyzer system according to Embodiment 2 of the present invention.

FIG. 13 is a block diagram illustrating a functional configuration of a state analyzer system according to Embodiment 2 of the present invention. The overall configuration of the state analyzer system according to Embodiment 2 is the same as the configuration illustrated in FIG. 1 referred to in Embodiment 1. The same components as those in Embodiment 1 described above are denoted by the same reference numerals and the description thereof will not be presented.

A state analyzer system 1000A in Embodiment 2 includes, in an air-conditioning apparatus 100, a state analysis device 300A that diagnoses malfunction of the air-conditioning apparatus 100 to be diagnosed. The state analysis device 300A includes a specific state determination unit 301, a normal region determination unit 302, a storage unit 303, a display processing unit 304, a communication unit 305, and a state diagnosis unit 306.

The state diagnosis unit 306 determines whether the air-conditioning apparatus 100 has an abnormality based on a positional relationship between specific state information x and a normal region X. Then, the state diagnosis unit 306 determines whether the specific state information x is present outside of the normal region X. Here, the fact that the specific state information x is present outside of the normal region X indicates that an abnormality has occurred in the air-conditioning apparatus 100 as in Embodiment 1. In other words, the state diagnosis unit 306 determines that the specific state information x deviates from the normal region X and the air-conditioning apparatus 100 has an abnormality.

When a plurality of specific positions are set, the state diagnosis unit 306 determines that the air-conditioning apparatus 100 has an abnormality when at least one of a plurality of pieces of specific state information x deviates from the normal region X corresponding thereto. For example, such a situation is the same as those illustrated in FIGS. 4 to 9 referred to in Embodiment 1. On the other hand, as illustrated in FIG. 3, when any of the plurality of pieces of specific state information x is present in the normal region X corresponding thereto, the state diagnosis unit 306 determines that the air-conditioning apparatus 100 is in a normal state.

When determining that the air-conditioning apparatus 100 has the abnormality, the state diagnosis unit 306 transmits an abnormality signal indicating that the air-conditioning apparatus 100 has the abnormality, via the communication unit 305, to at least one of a management apparatus 400 and an information terminal 500.

When the abnormality signal is transmitted from the state diagnosis unit 306, an output control unit 430 allows a display unit 421 to display abnormality information indicating the abnormality has occurred in the air-conditioning apparatus 100. Similarly, when the abnormality signal is transmitted from the state diagnosis unit 306, an output control unit 530 allows a display unit 521 to display abnormality information. When the abnormality signal is transmitted from the state diagnosis unit 306, the output control unit 430 may allow a notification unit 422 to notify notification information indicating that the abnormality has occurred in the air-conditioning apparatus 100. Similarly, when the abnormality signal is transmitted from the state diagnosis unit 306, the output control unit 530 may allow a notification unit 522 to notify notification information.

Here, when the abnormality signal is transmitted from the state diagnosis unit 306, the output control unit 430 and the output control unit 530 may be configured to perform both or either of the display of the abnormality information and the notification of the notification information. The notification information may be notified in the form of a beep sound and the like, or may also be notified in the form of a voice such as "abnormality has occurred".

When determining that the air-conditioning apparatus 100 is in the normal state, the state diagnosis unit 306 may transmit a normal signal indicating that the air-conditioning apparatus 100 is in the normal state, to at least one of the management apparatus 400 and the information terminal 500. In this case, in response to the normal signal, the output control unit 430 may allow the display unit 421 to display normal information indicating that the air-conditioning apparatus 100 is in the normal state, or may allow the notification unit 422 to notify normal notification information indicating that the air-conditioning apparatus 100 is in the normal state. Similarly, in response to the normal signal, the output control unit 530 may allow the display unit 521 to display normal information, or may allow the notification unit 522 to notify normal notification information.

In Embodiment 2, the display unit 421 or the display unit 521 is configured to display a diagnostic image including the specific state information x and the normal region X, as in Embodiment 1. Therefore, the abnormality information or the normal information may be displayed on the same screen together with the diagnostic image.

Figure 14:
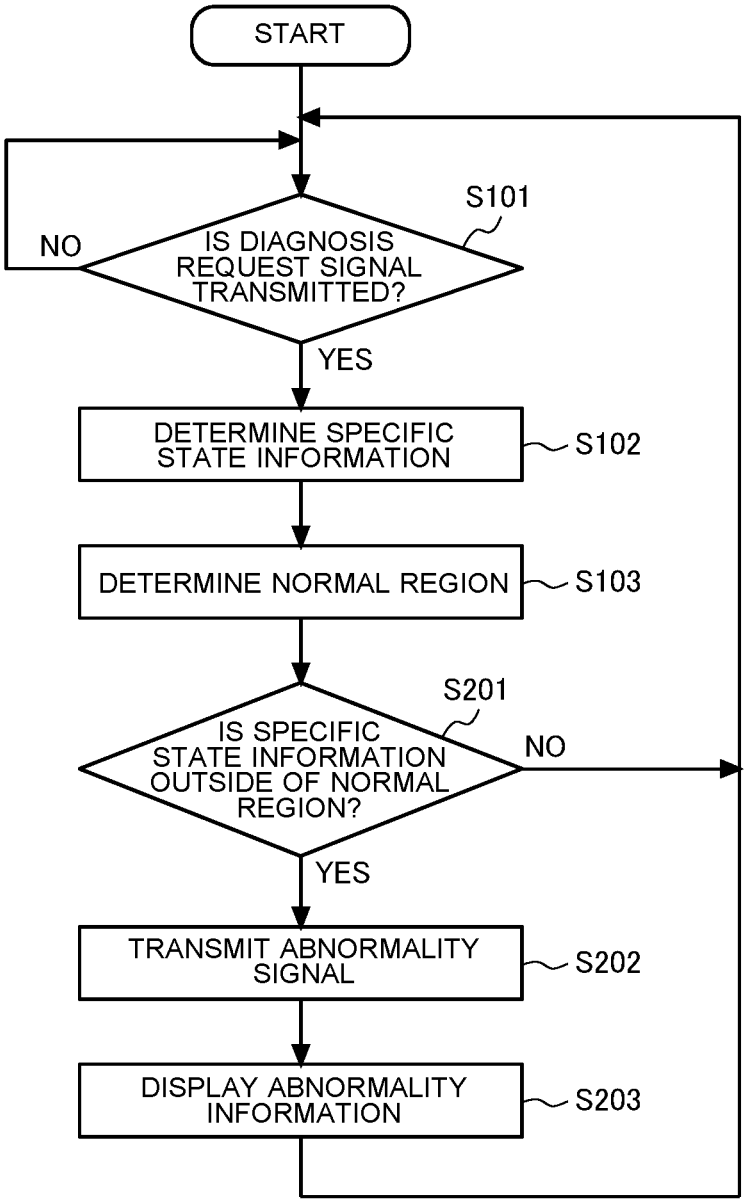
FIG. 14 is a flowchart illustrating state determination processing of the air-conditioning apparatus 100 in an operation of the state analyzer system illustrated in FIG. 13.

FIG. 14 is a flowchart illustrating state determination processing of the air-conditioning apparatus 100 in the operation of the state analyzer system illustrated in FIG. 13. A method of determining the state of the air-conditioning apparatus 100 in Embodiment 2 will be described with reference to FIG. 14. Here, a description will be given with respect to a case where the abnormality information is displayed on the display unit 521 of the information terminal 500.

The state analysis device 300A executes series of processes of steps S101 to S103 as in the processes of FIG. 10. Next, the state diagnosis unit 306 determines whether the specific state information x is present outside of the normal region X (step S201). When the specific state information x is present outside of the normal region X (YES in step S201), the state diagnosis unit 306 generates an abnormality signal and transmits it to the information terminal 500 (step S202). On the other hand, when the specific state information x is present within the normal region X (NO in step S201), the operation of the state analyzer system 1000 proceeds to the process of step S101.

When the abnormality signal is transmitted from the state diagnosis unit 306, the output control unit 530 allows the display unit 521 to display abnormality information (step S203). Then, the operation of the state analyzer system 1000 proceeds to the process of step S101. The operation when the abnormality information is displayed on the display unit 421 and the operation when the notification information is notified from the notification unit 422 or the notification unit 522 are the same as in the case of FIG. 14, and thus the description thereof will not be presented.

Here, the determination process and the transmission process of the abnormality signal or the normal signal (corresponding to steps S201 and S202 in FIG. 14, respectively) to be performed by the state diagnosis unit 306 are performed in parallel with the generation process and the transmission process of the display data (steps S104 and S105 in FIG. 10) to be performed by the display processing unit 304. In addition, the output control unit 430 and the output control unit 530 execute the display process or the notification process (corresponding to step S203 in FIG. 14) in parallel with the generation process and the display process of the diagnostic image (steps S106 and S107 in FIG. 10). Then, in Embodiment 2, the abnormality information or the normal information is displayed on the same screen together with the diagnostic image.

As described above, the state analysis device 300A and the state analyzer system 1000A in Embodiment 2 use the positional relationship between the specific state information x and the normal region X to determine whether the air-conditioning apparatus 100 has an abnormality. Therefore, the presence or absence of the abnormality in the air-conditioning apparatus 100 can be accurately determined. Then, it is determined that the specific state information x deviates from the normal region X and the air-conditioning apparatus 100 has the abnormality, so that the presence or absence of the abnormality in the specific position can be determined with high accuracy.

Further, the state analysis device 300A can determine the specific state information x for each of the plurality of specific positions and the normal region X corresponding to each of the pieces of specific state information x. Then, the state analysis device 300A and the state analyzer system 1000A determine the presence or absence of the abnormality in the air-conditioning apparatus 100 from the positional relationship between the specific state information x and the normal region X corresponding to each of the plurality of specific positions. Therefore, the abnormality in the air-conditioning apparatus 100 can be determined with high accuracy without being affected by the factor of the abnormality, thereby urging the user to take appropriate measures.

Furthermore, the state analyzer system 1000A includes an output unit configured to output the result of the process performed by the state diagnosis unit 306. The output unit outputs information indicating that the abnormality has occurred in the air-conditioning apparatus 100 when the specific state information x is present outside of the normal region X. In other words, the output unit is configured to display the abnormality information or notify the notification information when the specific state information x is present outside of the normal region X. Accordingly, the user can easily grasp the result of the determination made by the state analysis device 300A with eyes or ears, so that the usability can be improved.

As in Patent Literature 1, in the method of uniformly determining the necessity of maintenance by comparing the non-overlap ratio between the refrigeration cycle charts with the reference value, the determination result varies depending on the factor of malfunction that associates with the reference value. This is because the influence on the non-overlap ratio between the refrigeration cycle charts differs depending on the factor of the abnormality in the air-conditioning apparatus. For example, when the factor that the non-overlap ratio is relatively large is taken as a reference, the factor that the non-overlap ratio is relatively small is overlooked. On the other hand, when the factor that the non-overlap ratio is relatively small is taken as a reference, an erroneous determination occurs due to the factor that the non-overlap ratio is relatively large. In other words, the configuration disclosed in Patent Literature 1 cannot accurately determine whether the maintenance is necessary.

In this regard, the state analysis device 300A in Embodiment 2 can compare the specific state information x and the normal region X with each other for each of the specific positions by determining the specific state information x and the normal region X corresponding to the specific position of the refrigerant circuit 200, so that erroneous determination can be reduced. Other effects are similar to those of Embodiment 1.

FIG. 13 illustrates the case where the state analysis device 300A includes the display processing unit 304, but the state analysis device 300A may be configured without including the display processing unit 304 without being limited thereto. Even in this case, it is possible to notify the user of the abnormality in the air-conditioning apparatus 100 due to the determination with high accuracy based on the positional relationship between the specific state information x and the normal region X. Accordingly, the maintenance of the air-conditioning apparatus 100 can be urged to the user, so that the malfunction of the air-conditioning apparatus 100 can be prevented beforehand. The configuration of Embodiment 1 may be applied to the configuration of Modification 2. In other words, the display content or the notification content may be changed for each level in the normal region X within which the specific state information x is present. In addition, the configuration of Modification 2 may be applied to a configuration of Embodiment 3.

Embodiment 3

Figure 15:
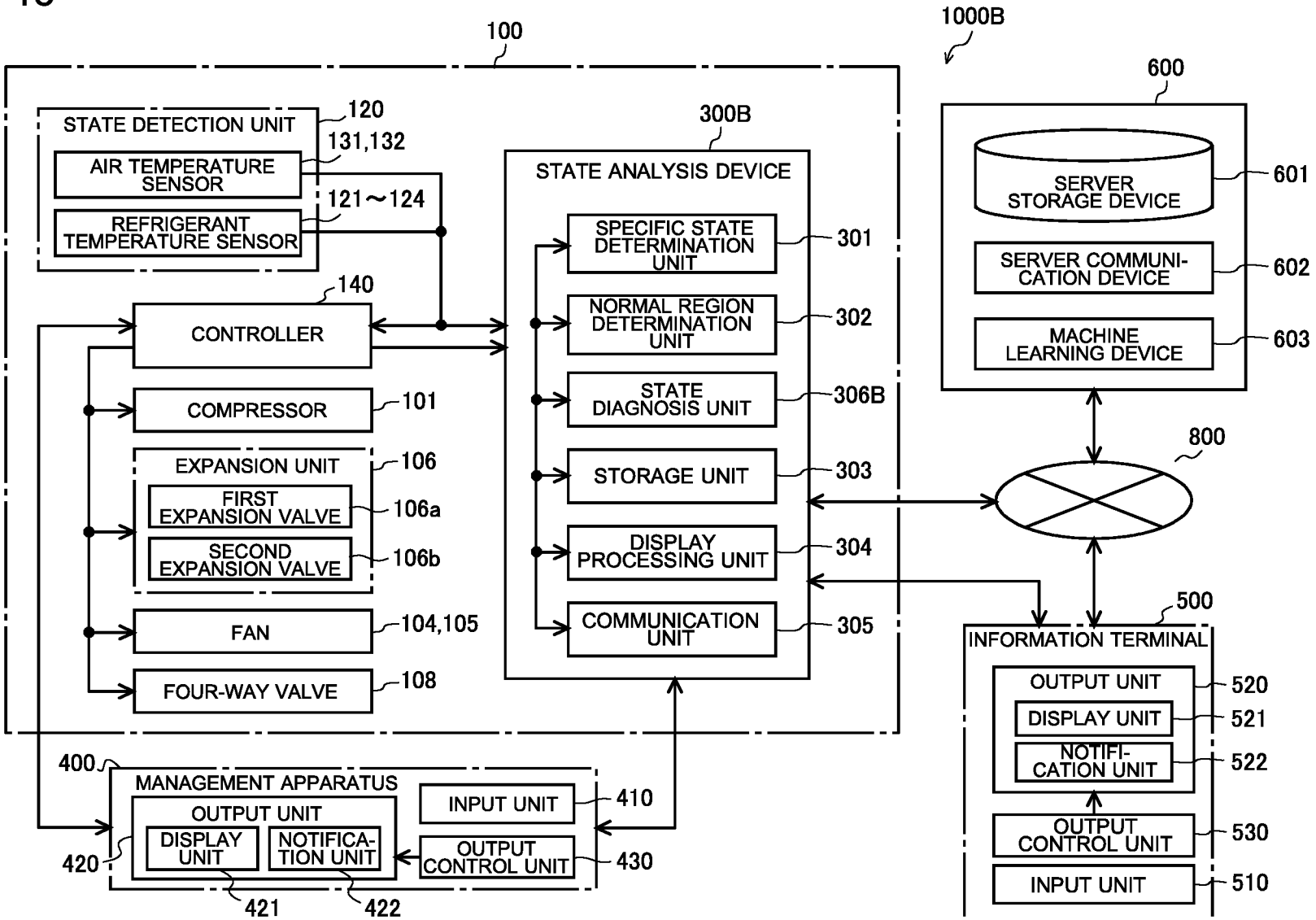
FIG. 15 is a block diagram illustrating a functional configuration of a state analyzer system according to Embodiment 3 of the present invention.

FIG. 15 is a block diagram illustrating a functional configuration of a state analyzer system according to Embodiment 3 of the present invention. The overall configuration of the state analyzer system according to Embodiment 3 is the same as the configuration illustrated in FIG. 1 referred to in Embodiment 1. The same components as those in Embodiments 1 and 2 described above are denoted by the same reference numerals and the description thereof will not be presented.

A state analyzer system 10006 in Embodiment 3 includes, in an air-conditioning apparatus 100, a state analysis device 300B that diagnoses malfunction of the air-conditioning apparatus 100 to be diagnosed. The state analysis device 300B includes a specific state determination unit 301, a normal region determination unit 302, a storage unit 303, a display processing unit 304, a communication unit 305, and a state diagnosis unit 306B.

When specific state information x is present outside of a normal region X, the state diagnosis unit 306B identifies a factor of an abnormality in the air-conditioning apparatus 100 based on a positional relationship between the specific state information x and the normal region X. When a plurality of specific positions are set, the state diagnosis unit 306 identifies a factor of an abnormality in the air-conditioning apparatus 100 when at least one of a plurality of pieces of specific state information x deviates from the normal region X corresponding thereto. Then, the state diagnosis unit 306B transmits factor data indicating the identified result of the factor of the abnormality to at least one of a management apparatus 400 and an information terminal 500 via a communication unit 305.

For example, the state diagnosis unit 306B identifies that the abnormality in the amount of refrigerant enclosed in the refrigerant circuit 200 is the factor when the positional relationship between the specific state information x and the normal region X is as illustrated in FIG. 4. The state diagnosis unit 306B identifies that the abnormality in the condenser or the abnormality in the fan attached to the condenser is the factor when the positional relationship between the specific state information x and the normal region X is as illustrated in FIG. 5. The state diagnosis unit 306B identifies that the abnormality in the evaporator or the abnormality in the fan attached to the evaporator is the factor when the positional relationship between the specific state information x and the normal region X is as illustrated in FIG. 6. The state diagnosis unit 306B identifies that the abnormality in the compressor 101 is the factor when the positional relationship between the specific state information x and the normal region X is as illustrated in FIG. 7. The state diagnosis unit 306B identifies that the flowing of the liquid refrigerant into the compressor 101 is the factor when the positional relationship between the specific state information x and the normal region X is as illustrated in FIG. 8. The state diagnosis unit 306B identifies that the abnormality in the expansion unit 106 or the abnormality in which the refrigerant circuit 200 has the clogging portion is the factor when the positional relationship between the specific state information x and the normal region X is as illustrated in FIG. 9.

When the factor data is transmitted from the state diagnosis unit 306, an output control unit 430 may allow the display unit 421 to display abnormality factor information indicating the factor of abnormality in the air-conditioning apparatus 100. Similarly, when the factor data is transmitted from the state diagnosis unit 306, an output control unit 530 may allow the display unit 521 to display abnormality factor information. When the factor information is transmitted from the state diagnosis unit 306, the output control unit 430 may allow a notification unit 422 to notify factor notification information indicating the factor of abnormality in the air-conditioning apparatus 100. Similarly, when the factor data is transmitted from the state diagnosis unit 306, the output control unit 530 may allow a notification unit 522 to notify factor notification information. First of all, when the factor data is transmitted from the state diagnosis unit 306, the output control unit 430 and the output control unit 530 may be configured to perform both or either of the display of the abnormality factor information and the notification of the factor notification information.

In Embodiment 3, the display unit 421 or the display unit 521 is configured to display a diagnostic image including the specific state information x and the normal region X, as in Embodiment 1. Therefore, the abnormality factor information may be displayed on the same screen together with the diagnostic image.

Figure 16:
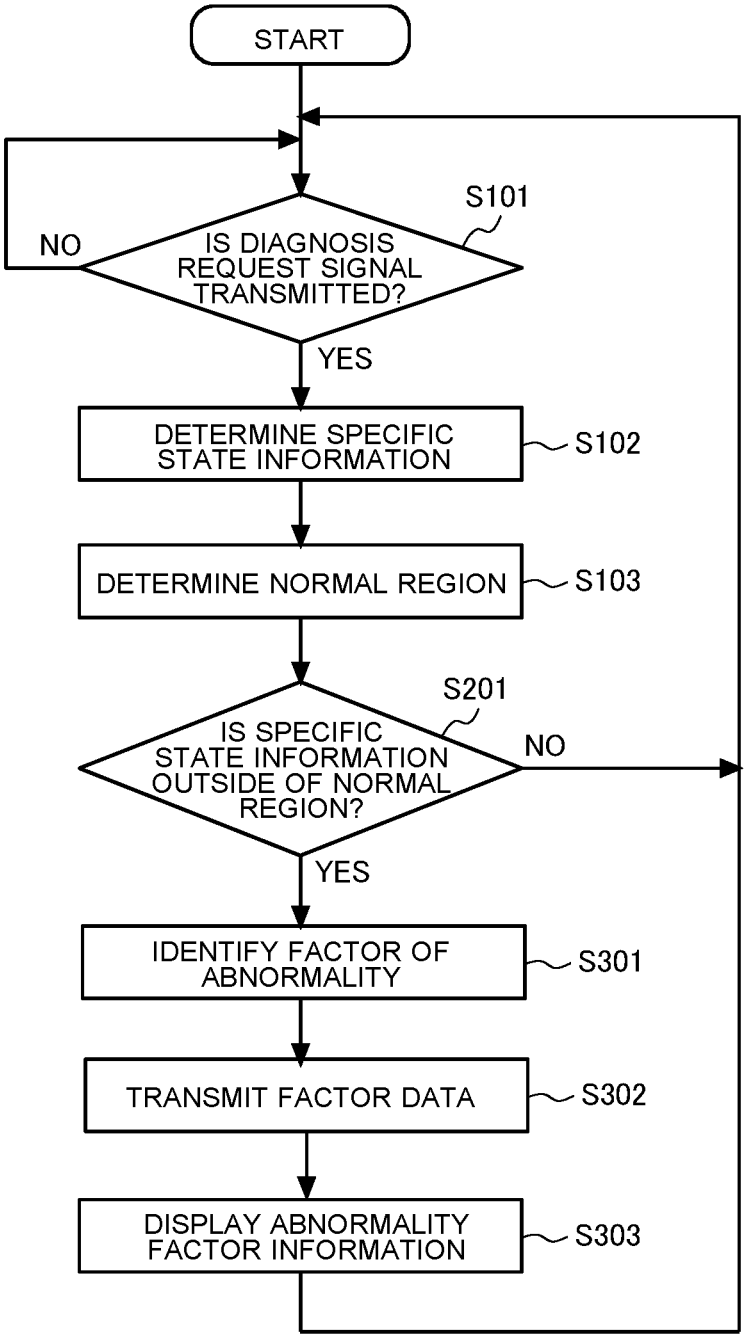
FIG. 16 is a flowchart illustrating state diagnosis processing of the air-conditioning apparatus 100 in an operation of the state analyzer system illustrated in FIG. 15.

FIG. 16 is a flowchart illustrating state diagnosis processing of the air-conditioning apparatus 100 in the operation of the state analyzer system illustrated in FIG. 15. A method of diagnosing the state of the air-conditioning apparatus 100 in Embodiment 3 will be described with reference to FIG. 16. Here, a description will be given with respect to a case where the abnormality factor information is displayed on the display unit 521 of the information terminal 500.

The state analysis device 300A executes series of processes of steps S101 to S103 and S201 as in the processes of FIG. 14. Next, the state diagnosis unit 306B identifies the factor of the abnormality in the air-conditioning apparatus 100 (step S301) when the specific state information x is present outside of the normal region X (YES in step S201). Then, the state diagnosis unit 306B generates factor data indicating the identified result of the factor of the abnormality and transmits it to the information terminal 500 (step S302).

When the factor data is transmitted from the state diagnosis unit 306B, the output control unit 530 allows the display unit 521 to display abnormality factor information (step S303). Then, the operation of the state analyzer system 1000 proceeds to the process of step S101. The operation when the abnormality factor information is displayed on the display unit 421 and the operation when the factor notification information is notified from the notification unit 422 or the notification unit 522 are the same as in the case of FIG. 16, and thus the description thereof will not be presented.

The determination process and the transmission process of the factor data (corresponding to step S201 and S301 in FIG. 16, respectively) to be performed by the state diagnosis unit 306B are performed in parallel with the generation process and the transmission process of the display data (steps S104 and S105 in FIG. 10) to be performed by the display processing unit 304. In addition, the output control unit 430 and the output control unit 530 execute the display process or the notification process (corresponding to step S303 in FIG. 16) in parallel with the generation process and the display process of the diagnostic image (steps S106 and S107 in FIG. 10). Then, in Embodiment 3, the abnormality factor information is displayed on the same screen together with the diagnostic image.

As described above, the state analysis device 300B and the state analyzer system 1000B in Embodiment 3 use the positional relationship between the specific state information x and the normal region X to identify the factor of the abnormality in the air-conditioning apparatus 100. Therefore, the factor of the abnormality in the air-conditioning apparatus 100 can be accurately identified. In addition, the state analysis device 300B can determine the specific state information x for each of the plurality of specific positions and the normal region X corresponding to each of the pieces of specific state information x. Then, the state analysis device 300B and the state analyzer system 10006 identify the factor of the abnormality in the air-conditioning apparatus 100 in consideration of the positional relationship between the specific state information x and the normal region X corresponding to each of the plurality of specific positions. Therefore, various factors related to the abnormality in the air-conditioning apparatus 100 can be diagnosed with high accuracy.

Furthermore, the state analyzer system 10006 includes an output unit configured to output the result of the process performed by the state diagnosis unit 306B. The output unit outputs information indicating the factor of the abnormality in the air-conditioning apparatus 100 identified by the state diagnosis unit 306B. Accordingly, the user can easily recognize the state of the air-conditioning apparatus 100 with eyes or ears, so that the convenience of the user can be improved.

In the conventional configuration, the user needs to acquire specialized knowledge in advance, for example, the degree of influence for each factor of the abnormality to appropriately extract the factor of the abnormality in the air-conditioning apparatus 100. On the other hand, according to the state analyzer system 10006, the user can easily know the factor of the abnormality from the information output by the output unit, so that the user can obtain a highly accurate diagnosis result without having specialized knowledge.

FIG. 15 illustrates the case where the state analysis device 300B includes the display processing unit 304, but the state analysis device 300B may be configured without including the display processing unit 304 without being limited thereto. Even in this case, it is possible to notify the user of the factor of the abnormality in the air-conditioning apparatus 100 due to the diagnosis with high accuracy based on the positional relationship between the specific state information x and the normal region X. Accordingly, the user can perform targeted maintenance in a state of checking the specific position of the air-conditioning apparatus 100. The configuration of Embodiment 3 can be used in combination with the configuration of Embodiment 2 described above. Further, the configuration of Modification 1 may be applied to the configuration of Embodiment 3. In other words, the content of the abnormality factor information or the content of the factor notification information may be changed for each level in the normal region X within which the specific state information x is present. In addition, the configuration of Modification 2 may be applied to a configuration of Embodiment 3. Other effects are similar to those of Embodiments 1 and 2.

Embodiment 4

Figure 17:
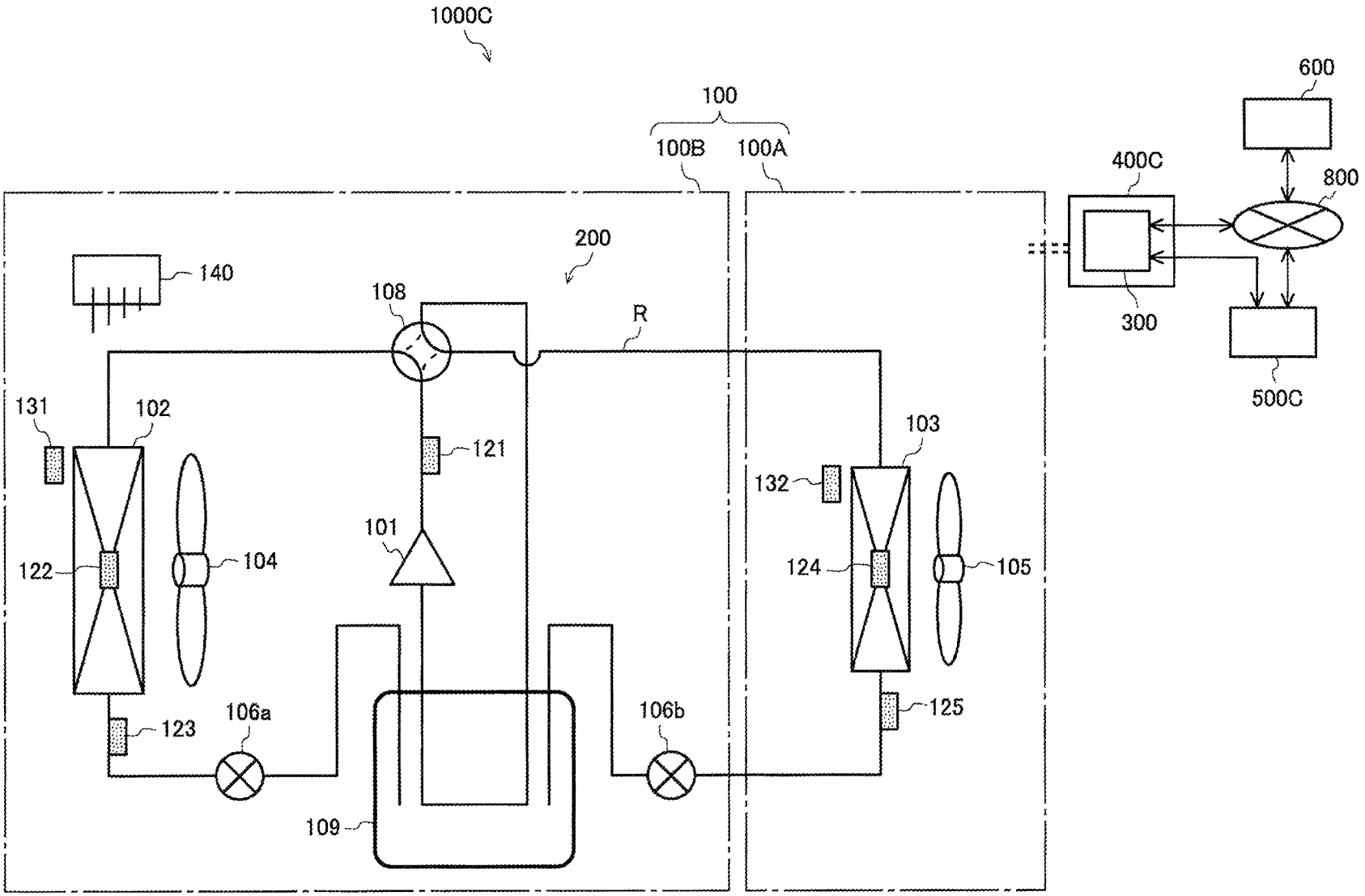
FIG. 17 is a configuration diagram illustrating a state analyzer system according to Embodiment 4 of the present invention.
Figure 18:
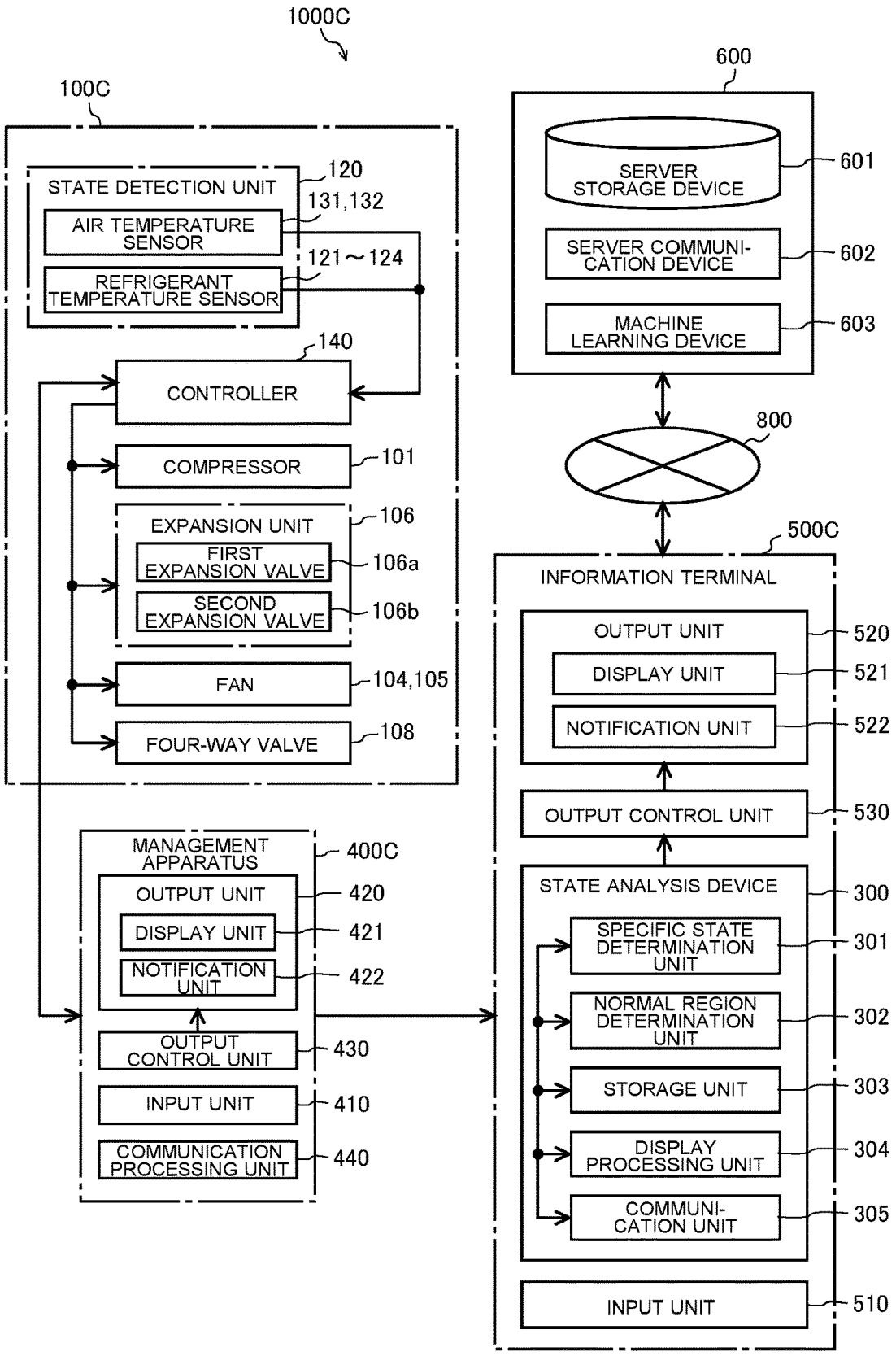
FIG. 18 is a block diagram illustrating a functional configuration of the state analyzer system illustrated in FIG. 17.

FIG. 17 is a configuration diagram illustrating a state analyzer system according to Embodiment 4 of the present invention. FIG. 18 is a block diagram illustrating a functional configuration of the state analyzer system illustrated in FIG. 17. The state analyzer system of Embodiment 4 is characterized in that the state analysis device is not provided inside the air-conditioning apparatus. The same components as those in Embodiments 1 to 3 described above are denoted by the same reference numerals and the description thereof will not be presented.

A state analyzer system 1000C of Embodiment 4 includes an air-conditioning apparatus 100C, a management apparatus 400C, an information terminal 500C, and a server apparatus 600. The air-conditioning apparatus 100C has the same configuration as the air-conditioning apparatuses 100 of Embodiments 1 to 3, except for not including the state analysis device 300.

The management apparatus 400C includes a communication processing unit 440 that relays data communication between the air-conditioning apparatus 100 and the information terminal 500C. The communication processing unit 440 integrates state data and control data once in an internal memory of the management apparatus 400C, and then forwards the state data and control data to the state analysis device 300 provided in the information terminal 500C.

In other words, the communication processing unit 440 acquires state data from a state detection unit 120 including refrigerant temperature sensors 121 to 125 and air temperature sensors 131 and 132, and delivers the acquired state data to the state analysis device 300 of the information terminal 500C. In addition, the communication processing unit 440 acquires control data indicating the content of control for each actuator of a controller 140 from the air-conditioning apparatus 100C, and delivers the acquired control data to the state analysis device 300 of the information terminal 500C. Then, the information terminal 500C includes the state analysis device 300 that analyzes the state of the air-conditioning apparatus 100C using the state data and the control data acquired via the management apparatus 400C.

For example, high-performance applications can be installed in smartphones that have become widespread in recent years. In other words, when the information terminal 500C is a smartphone, the state analysis device 300 is installed as an application for the smartphone.

In FIGS. 17 and 18, the information terminal 500C includes the state analysis device 300 configured similarly to that of Embodiment 1, but is not limited thereto. The information terminal 500C may include the state analysis device 300A of Embodiment 2 or the state analysis device 300B of Embodiment 3. In other words, the state analyzer system 1000C may employ the configuration of Modification 1, Modification 2, Embodiment 2, or Embodiment 3, or a combination of two or more of these configurations.

As described above, according to Embodiment 4, since the state analysis device 300 is provided in the information terminal 500C, the air-conditioning apparatus 100C can be manufactured at a low cost as compared with the configurations of Embodiments 1 to 3. In the state analyzer system 1000C, the state analysis device 300, the state analysis device 300A, or the state analysis device 300B may be provided in the management apparatus 400C. The operation of the state analyzer system 1000C of Embodiment 4 is similar to that of Embodiments 1 to 3.

Embodiment 5

An overall configuration and a functional configuration of a state analyzer system according to Embodiment 5 are the same as those illustrated in FIGS. 1, 2, 13, 15, 17, and 18 referred to in Embodiments 1 to 4. Embodiments 1 to 4 described above exemplify the case where the state of the air-conditioning apparatus is analyzed when the state analysis is requested from the outside. In other words, Embodiments 1 to 4 exemplify an example in which the state of the air-conditioning apparatus is analyzed in response to the request from the user. On the other hand, in Embodiment 5, the state of the air-conditioning apparatus is analyzed, for example, at regular time intervals instead of the request from the user. The same components as those in Embodiments 1 to 4 described above are denoted by the same reference numerals and the description thereof will not be presented. Hereinafter, unless otherwise described, the reference numerals used in Embodiment 1 will be used.

The state analysis device 300 of Embodiment 5 has a function of managing a time or a function of measuring a time. Therefore, the state analyzer system 1000 is configured to analyze the state of the air-conditioning apparatus 100 at the same time every day. Further, the state analyzer system 1000 is configured to analyze the state of the air-conditioning apparatus 100 for each set time. The set time is set to, for example, 24 hours and can be changed appropriately.

Figure 19:
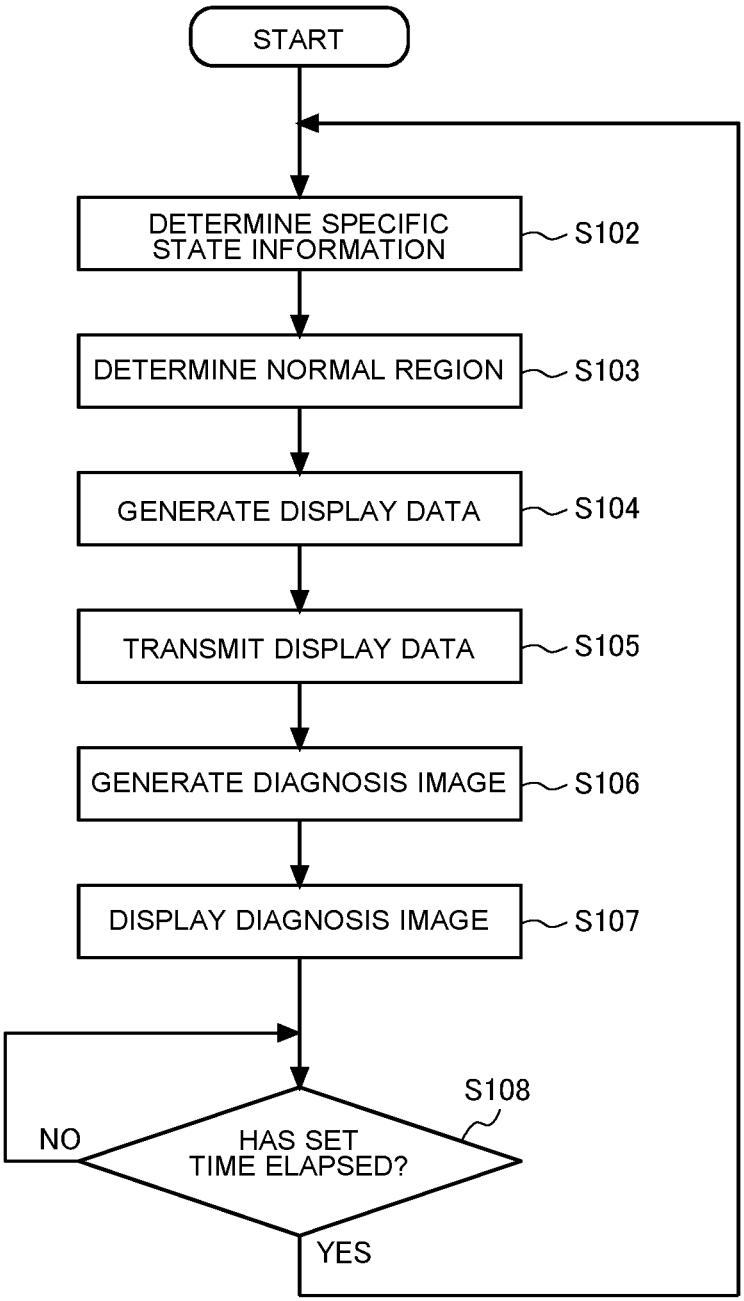
FIG. 19 is a flowchart illustrating an operation of a state analyzer system according to Embodiment 5 of the present invention.

FIG. 19 is a flowchart illustrating an operation of the state analyzer system according to Embodiment 5 of the present invention. A description will be given below with respect to a state diagnosis method in the case of performing the state analysis for each set time. The same steps as those in FIG. 10 are denoted by the same reference numerals and the description thereof will not be presented. The state analyzer system 1000 is configured to analyze the state of the air-conditioning apparatus 100 for each set time.

The state analyzer system 1000 executes a series of processes of steps S102 to S107 in response to an instruction operation for regular diagnosis from the user. Then, the state analyzer system 1000 waits until the set time elapses from when the state analysis of the air-conditioning apparatus 100 starts (step S108). After the set time elapses, the state analyzer system 1000 proceeds to the process of step S102. When the state analysis is performed at the same time every day, a series of processes of steps S102 to S107 is executed when a designated time comes. The designated time may be set for each day of the week or each date. Further, a plurality of designated times may be set for one day. Then, the set number of designated times may be changed for each day of the week or each date. The operation is described above assuming that the configuration of Embodiment 1 is applied, but is the same as that of each of the embodiments when the configurations of Embodiments 2 to 4 are applied.

The above-described embodiments are preferred specific examples of the state analysis device and the state analyzer system, and the technical scope of the present invention is not limited to these aspects. For example, the state detection unit 120 is not limited to the above configuration. As an example, the state detection unit 120 may include a refrigerant temperature sensor that is provided at the suction side of the compressor 101 to measure the temperature of the refrigerant suctioned into the compressor 101, instead of the refrigerant temperature sensor 121. Each sensor of the state detection unit 120 is not limited to the temperature sensor, and the state detection unit 120 may include, for example, a pressure sensor that measures a pressure of the refrigerant or an infrared camera that measures a temperature of a non-contact portion. Each of the above-described embodiments exemplifies the case where the server apparatus 600 is the cloud server based on cloud computing, but the server apparatus 600 may be a physical server such as a Web server.

The refrigerant circuit 200 is not limited to the configurations illustrated in FIGS. 1 and 17, and the air-conditioning apparatus 100 can be mounted with the refrigerant circuits 200 having various configurations. Then, the state analysis device 300 can analyze states of the refrigerant circuits 200 having various configurations in the same manner as above. For example, FIG. 1 illustrates the case where the expansion unit 106 includes the first expansion valve 106*a* and the second expansion valve 106*b*, but the expansion unit 106 may be one expansion valve that is an electronic expansion valve, for example. In the above description, three specific positions are set as a specific example, but the set number of specific positions may be one, two, or four or more.

REFERENCE SIGNS LIST

11 compressor 100, 100C air-conditioning apparatus 100A outdoor unit 1006 indoor unit 101 compressor 102 outdoor heat exchanger 103 indoor heat exchanger 104 outdoor fan 105 indoor fan 106 expansion unit

106*a* first expansion valve 106*b* second expansion valve 108 four-way valve 109 receiver 120 state detection unit 121 to 125 refrigerant temperature sensor 131 to 132 air temperature sensor 140 controller 200 refrigerant circuit 300, 300A, 300B state analysis device 301 specific state determination unit 302 normal region determination unit 303 storage unit 304 display processing unit 305 communication unit 306, 306B state diagnosis unit 400, 400C management apparatus 410, 510 input unit 420, 520 output unit 421, 521 display unit 422, 522 notification unit 430, 530 output control unit 440 communication processing unit 500, 500C information terminal 600 server apparatus 601 server storage device 602 server communication device 603 machine learning device 800 telecommunication line 1000, 1000A, 1000B, 1000C state analyzer system A inlet region A1 first inlet region A2 second inlet region B outlet region B1 first outlet region B2 second outlet region C condensation region C1 first condensation region C2 second condensation region R refrigerant pipe Rc, Rc1, Rc2 refrigeration cycle chart S saturation line Tin, Tout isothermal line X normal region a, a1, a2 inlet information b, b1, b2 outlet information c, c1, c2 condensation information x specific state information.

The invention claimed is:

1. A state analyzer system comprising:

an air-conditioning apparatus including a refrigerant circuit including a compressor and an expansion unit, a controller being configured to detect a state of refrigerant in the refrigerant circuit as state data while the compressor is running, and control the compressor and the expansion unit;

a state analyzer device comprising a processor, and a display, the processor of the state analyzer device being configured to:

acquire the state data and control data from the controller of the air-conditioning apparatus, determine and continuously update a plurality of pieces of specific state information by using the state data and the control data, the control data indicating a content of control performed by the controller, the plurality of pieces of specific state information each representing, as a point, a state of the refrigerant at each of a plurality of specific positions in the refrigeration circuit, and being located in a state space defined by a pressure of the refrigerant and an enthalpy;

determine, by using the state data and the control data, a plurality of normal regions in the state space within which each of the plurality of pieces of specific state information is present when the air-conditioning apparatus operates under a normal state; and control the display to display a diagnostic image including the plurality of pieces of specific state information of the refrigerant in the refrigerant circuit as the compressor is running, and simultaneously superimposed thereon the plurality of normal regions determined by the state analyzer device.

2. The state analyzer system of claim 1, wherein the processor of the state analyzer device is further configured to:

based on a positional relationship of each of the plurality of pieces of specific state information and a corresponding one of the plurality of normal regions, determine whether the air-conditioning apparatus has an abnormality.

3. The state analyzer system of claim 2, wherein the processor of the state analyzer device is further configured to determine that the air-conditioning apparatus has the abnormality when at least one of the plurality of pieces of specific state information is present outside of the corresponding one of the normal regions.

4. The state analyzer system of claim 2, wherein the processor of the state analyzer device is further configured to control the display to display information indicating that the abnormality occurs in the air-conditioning apparatus when at least one of the plurality of pieces of specific state information is present outside of the corresponding one of the normal regions.

5. The state analyzer system of any one of claim 2, wherein the processor of the state analyzer device is configured to identify a factor of the abnormality in the air-conditioning apparatus, based on the positional relationship of each of the plurality of pieces of specific state information and the corresponding one of the plurality of normal regions, and control the display to display information indicating the factor of the abnormality in the air-conditioning apparatus identified by the state analyzer device.

6. The state analyzer system of claim 5, wherein the refrigerant circuit includes a condenser and an evaporator, and the processor of the state analyzer device identifies, as the factor of the abnormality in the air-conditioning apparatus, at least one of:

an abnormality in an amount of refrigerant enclosed in the refrigerant circuit;

an abnormality in the condenser or the evaporator;

an abnormality in the compressor;

an abnormality in which liquid refrigerant flows into the compressor;

an abnormality in the expansion unit; and an abnormality in which the refrigerant circuit has a clogging portion.

7. The state analyzer system of claim 5, wherein the refrigerant circuit includes a condenser and an evaporator, the air-conditioning apparatus has fans each being attached to the condenser and the evaporator, and the processor of the state analyzer device identifies, as the factor of the abnormality in the air-conditioning apparatus, at least one of:

an abnormality in the fan attached to the condenser; and an abnormality in the fan attached to the evaporator.

8. The state analyzer system of claim 1, wherein the processor of the state analyzer device is further configured to control the display to display the diagnostic image including, not only the plurality of pieces of specific state information and the plurality of normal regions but also an isothermal line indicating a temperature of an environment in which the air-conditioning apparatus is installed.

9. The state analyzer system of claim 1, further comprising:

a storage device configured to store the state data and the control data, wherein the processor of the state analyzer device is further configured to accumulate the plurality of pieces of specific state information in the storage device or a server apparatus provided outside the air-conditioning apparatus for a preset certain period, and control the display to display the diagnostic image including a plurality of current pieces of specific state information and a plurality of past pieces of the specific state information.

10. The state analyzer system of claim 1, wherein the display is provided in at least one of a remote controller, a centralized management apparatus, a mobile phone, and a personal computer that are informationally connected to the air-conditioning apparatus.

11. The state analyzer system of claim 1, further comprising:

a storage device configured to store the state data and the control data, wherein the processor of the state analyzer device is further configured to determine the normal region by using the state data and the control data accumulated in the storage device.

12. The state analyzer system of claim 1, wherein the processor of the state analyzer device is further configured to accumulate the state data and the control data in a server apparatus provided outside the air-conditioning apparatus, and determine the normal region by using the state data and the control data accumulated in the server apparatus.

13. The state analyzer system of claim 1, wherein the processor of the state analyzer device is further configured to determine the normal region by using information on design specifications of the air-conditioning apparatus.

14. The state analyzer system of claim 1, wherein the processor of the state analyzer device is further configured to determine the normal region based on machine learning using the state data and the control data.

15. The state analyzer system of claim 1, wherein the processor of the state analyzer device is further configured to determine, as each of the normal regions, a plurality of regions to be determined depending on a degree of the abnormality in the air-conditioning apparatus, wherein in each of the normal regions, a point of relatively large degree of abnormality of the air-conditioning apparatus is on outside, around points of relatively small degree of abnormality on inside.

16. The state analyzer system of claim 15, wherein the refrigerant circuit includes a condenser, the processor of the state analyzer device is further configured to determine each of the specific state information including:

inlet information indicating a state of refrigerant at an inlet of the compressor;

outlet information indicating a state of refrigerant at an outlet of the compressor; and condensation information indicating a state of refrigerant at an outlet of the condenser, and determine each of the normal regions including:

an inlet region where the inlet information is present when the air-conditioning apparatus operates under the normal state;

an outlet region where the outlet information is present when the air-conditioning apparatus operates under the normal state; and a condensation region where the condensation information is present when the air-conditioning apparatus operates under the normal state.

17. The state analyzer system of claim 1, wherein the processor of the state analyzer device is further configured to analyze a state of the air-conditioning apparatus when a state analysis is requested from an outside.

18. The state analyzer system of claim 1, wherein the processor of the state analyzer device is further configured to analyze a state of the air-conditioning apparatus at regular time intervals.

19. A state analyzer system comprising:

an air-conditioning apparatus including a refrigerant circuit including a compressor and an expansion unit, the air-conditioning apparatus being configured to detect a state of refrigerant in the refrigerant circuit as state data while the compressor is running, and a controller configured to control the compressor and the expansion unit; and a state analyzer device comprising a processor, the processor of the state analyzer device being configured to:

acquire the state data and control data from the controller of the air-conditioning apparatus, determine and continuously update a plurality of pieces of specific state information by using the state data and the control data, the control data indicating a content of control performed by the controller, the plurality of pieces of specific state information each representing, as a point, a state of the refrigerant at each of a plurality of specific positions in the refrigeration circuit, and being located in a state space defined by a pressure of the refrigerant and an enthalpy;

determine, by using the state data and the control data, a plurality of normal regions in the state space within which each of the plurality of pieces of specific state information is present when the air-conditioning apparatus operates under a normal state; and based on a positional relationship of each of the plurality of pieces of specific state information of the refrigerant in the refrigerant circuit as the compressor is running and the corresponding one of the plurality of normal regions, determine whether the air-conditioning apparatus has an abnormality.

20. The state analyzer system of claim 19, wherein the processor of the state analyzer device is further configured to determine that the air-conditioning apparatus has the abnormality when at least one of the plurality of pieces of specific state information is present outside of the corresponding one of the normal regions.

21. The state analyzer system of claim 20, further comprising:

an output configured to output a result processed by the state analyzer device, wherein the processor of the state analyzer device is further configured to control the output to output information indicating that the abnormality occurs in the air-conditioning apparatus when at least one of the plurality of pieces of specific state information is present outside of the corresponding one of the normal regions.

22. The state analyzer system of claim 19, further comprising:

an output configured to output information on a result processed by the state analyzer device, wherein the processor of the state analyzer device is configured to identify a factor of the abnormality in the air-conditioning apparatus, based on the positional relationship of each of the plurality of pieces of specific state information and the corresponding one of the normal regions, and control the output to output information indicating the factor of the abnormality in the air-conditioning apparatus identified by the state analyzer device.

23. The state analyzer system of claim 21, wherein the output includes a display, and the processor of the state analyzer device is further configured to control the display to display a diagnostic image including the plurality of pieces of specific state information and the corresponding one of the plurality of normal regions determined by the state analyzer device.

24. A state analysis device that analyzes a state of an air-conditioning apparatus by using state data and control data and controls a display, which is provided outside, to display an analysis result, the air-conditioning apparatus including a refrigerant circuit including a compressor and an expansion unit and a controller configured to control the compressor and the expansion unit, the state data indicating a state of refrigerant in the refrigerant circuit while the compressor is running, the control data indicating a content of control performed by the controller, the state analysis device comprising a processor being configured to:

acquire the state data and the control data from the controller of the air-conditioning apparatus, determine and continuously update specific state information by using the state data and the control data, the plurality of pieces of specific state information each representing, as a point, a state of the refrigerant at each of a plurality of specific positions in the refrigeration circuit, and being located in a state space defined by a pressure of refrigerant and an enthalpy;

determine, by using the state data and the control data, a plurality of normal regions in the state space within which each of the plurality of pieces of specific state information is present when the air-conditioning apparatus operates under a normal state; and control the display to display a diagnostic image including the plurality of pieces of specific state information of the refrigerant in the refrigerant circuit as the compressor is running, and simultaneously superimposed thereon a plurality of normal regions.

* * * * *